US005573059A

United States Patent [19]

Hamamoto et al.

[11] Patent Number: 5,573,059

[45] Date of Patent: Nov. 12, 1996

[54] AIR CONDITIONING MACHINE

[75] Inventors: Shotaro Hamamoto, Funabashi; Shigeru Niki, Fuji; Atsushi Nagasawa, Mishima; Masao Isshiki, Fuji; Yoichiro Kobayashi, Fuji; Jitsuo Ikeya, Fuji, all of Japan

[73] Assignee: Kabushiki Kaisha Toshiba, Japan

[21] Appl. No.: 305,942

[22] Filed: Sep. 15, 1994

[30] Foreign Application Priority Data

| | | | |
|---|---|---|---|
| Feb. 21, 1994 | [JP] | Japan | 6-022742 |
| Mar. 18, 1994 | [JP] | Japan | 6-048046 |
| Mar. 18, 1994 | [JP] | Japan | 6-048047 |
| Mar. 18, 1994 | [JP] | Japan | 6-048048 |
| Mar. 18, 1994 | [JP] | Japan | 6-048049 |

[51] Int. Cl.[6] ..... F28F 13/12

[52] U.S. Cl. ..... 165/124; 165/122; 165/151

[58] Field of Search ..... 165/122, 124, 165/151, 146, 144, 145; 416/187; 415/53.1

[56] References Cited

U.S. PATENT DOCUMENTS

| | | | |
|---|---|---|---|
| 1,143,365 | 6/1915 | Davidson | 416/187 |
| 2,980,990 | 4/1961 | Sprouse | 416/187 X |
| 4,906,219 | 3/1990 | Matousek et al. | 416/187 X |
| 5,174,366 | 12/1992 | Nagakura et al. | 165/151 X |
| 5,211,219 | 5/1993 | Kawabata et al. | 165/122 |
| 5,279,360 | 1/1994 | Hughes et al. | 165/153 X |

FOREIGN PATENT DOCUMENTS

| | | | |
|---|---|---|---|
| 128038 | 6/1986 | Japan | 165/122 |
| 195021 | 12/1987 | Japan . | |
| 106632 | 4/1990 | Japan | 165/151 |
| 68921 | 6/1992 | Japan | 165/122 |
| 97222 | 8/1992 | Japan . | |
| 103512 | 9/1992 | Japan . | |
| 270892 | 9/1992 | Japan | 165/151 |
| 288420 | 10/1992 | Japan | 165/151 |
| 350426 | 12/1992 | Japan | 165/151 |
| 8316 | 2/1993 | Japan | 165/122 |

*Primary Examiner*—Leonard R. Leo

*Attorney, Agent, or Firm*—Cushman Darby & Cushman, LLP

[57] ABSTRACT

An air conditioning machine has a unit main body having an inlet port and an outlet port. The unit main body includes a cross flow fan, having a circular cross section, for introducing indoor air into the unit main body through the inlet port and blowing the air into the room. A heat exchanger is arranged on an indoor air introducing side of the cross flow fan and bent at a portion along a longitudinal direction of the heat exchanger at an acute angle. The heat exchanger has a front side heat exchanger located on a front side of the air conditioning machine and curved along the circular cross section of the cross flow fan and a rear side heat exchanger located on a rear side thereof.

17 Claims, 15 Drawing Sheets

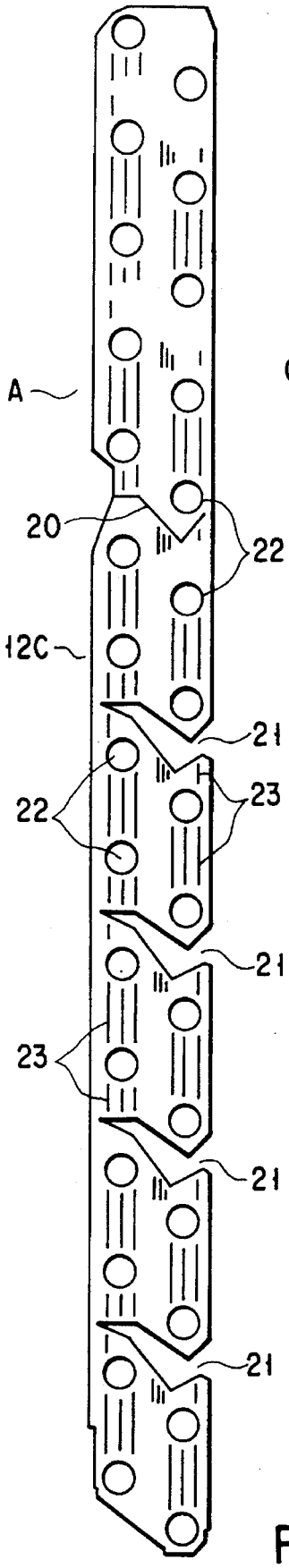
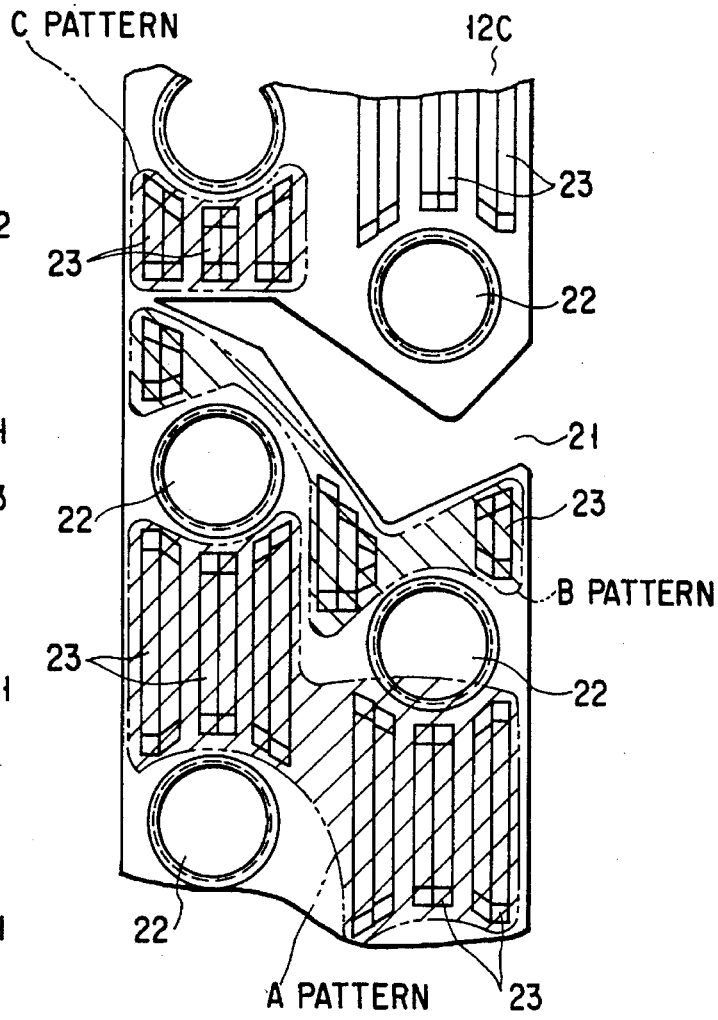
FIG. 6B
FIG. 6A

AIR CONDITIONING MACHINE

BACKGROUND OF THE INVENTION

1. Field of the Invention

The present invention relates to an air conditioning machine having indoor and outdoor units, and more particularly to an improvement of the heat exchangers provided in the indoor and outdoor units.

2. Description of the Related Art

An air conditioner in general comprises an indoor unit positioned in a room to be air-conditioned and an outdoor unit positioned outdoors, which are connected to each other via refrigerant tubes and electrical wires.

Since users' demands for a decrease in the size and space required for these units has been increasing, manufacturers must increase the heat exchanging performance of an air conditioner, while satisfying the user's demand.

For this purpose, for example, a middle portion of the heat exchanger in the vertical direction of an indoor unit is bent at an obtuse angle and protruded outward, so that the heat exchange area is maintained, while the height of the heat exchanger is reduced, thereby reducing the height of the unit body.

The indoor unit comprises an air blowing fan for taking air in the room into the unit body, causing the air to flow through the heat exchanger, subjecting the air to heat exchange, and blowing the heat-exchanged air back into the room. A cross flow fan is selected as the air blowing fan in view of its property.

The length of the cross flow fan in its axial direction is substantially the same as the width of the heat exchanger. The cross flow fan comprises circular end plates, partitioning plates arranged at intervals, and a number of blades arranged along the circumferential end portions of the partitioning plates. The cross section of the cross flow fan is substantially circular.

In order to suppress the size of the unit body to as small as possible, the diameter of the cross flow fan is set to as small a size as possible, while still being capable of providing the necessary amount of air.

In the above heat exchanger, the cross flow fan is arranged at the back of the bent portion. Depending on the position of the bent portion, at least one of the upper and lower ends of the heat exchanger is spaced apart far from the cross flow fan.

The heat-exchanged air is not sufficiently introduced to portions apart from the heat exchanger, resulting in inconsistencies in heat exchange efficiency in different portions.

Jpn. UM Appln. KOKAI Publication No. 4-68921 discloses a heat exchanger having an improved structure to overcome the above problem.

As shown in FIG. 16, a heat exchanger H is divided into three parts, so that an upper portion forms an acute angle (an inverted v shape), and a front portion is bent at an obtuse angle and protruded outward. A fan F is arranged in the heat exchanger H.

With this heat exchanger H, the height thereof can be reduced as compared with a heat exchanger in which only the middle portion is bent. In addition, since the upper and lower end portions of the heat exchanger can be positioned near the fan F, the heat exchange efficiency can be improved.

However, in a front portion Ha of the heat exchanger H corresponding to a front inlet port a, through which the greatest amount of air is introduced, since the middle portion of the heat exchanger is bent at an obtuse angle and protruded outward as in the conventional heat exchanger described above, the distances (La to Ld) between the back surface of the front portion Ha and the circumferential surface of the fan F differ greatly from each other.

As a result, in that portion of the heat exchanger H corresponding to a front inlet port a, through which the greatest amount of air is introduced, the air inlet pressure is liable to vary, resulting in a lack of uniformity in the amount of inlet air.

In addition, since the fan F generates a rustling sound when blowing air, a silent operation cannot be achieved. Moreover, since the amount of inlet air is not uniform, the heat exchange efficiency improves very little. Further improvement of the heat exchanger is required.

SUMMARY OF THE INVENTION

An object of the present invention is to provide an air conditioning machine, in which the shape and structure of heat radiating fins constituting a heat exchanger are optimized to reduce the height of the heat exchanger, thereby reducing the size of the heat exchanger and the unit body; the distance between the heat exchanger and the circumferential surface of the air blowing fan is uniform, so that the inlet air pressure and the amount of inlet air can be uniform; the air blowing sound can be reduced; and the heat exchange efficiency can be improved.

The air conditioner of the present invention comprises:

an air conditioning main body having an inlet port and an outlet port;

an air blowing fan, provided in the air conditioning main body, for introducing air in a room into the air conditioning main body through the inlet port and blowing the air into the room through the outlet port, the air blowing fan having a circular cross section; and a heat exchanger provided in an indoor air introducing side of the air blowing fan, bent at a portion along a longitudinal direction of the heat exchanger at an acute angle, and having a front side heat exchanger located on a front side of the air conditioning machine and curved along the circular cross section of the air blowing fan and a rear side heat exchanger located on a rear side thereof.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1, 2A and 2B show an indoor unit of an air conditioning machine according to a first embodiment of the present invention, in which FIG. 1 is a longitudinal cross-sectional view of the indoor unit;

FIG. 2A is a longitudinal cross-sectional view of a heat exchanger of the indoor unit;

FIG. 2B is a perspective view of part of a heat radiating fin of the indoor unit;

FIGS. 5, 6A and 6B show a further embodiment of the present invention, in which

FIG. 5 is a longitudinal cross-sectional view of an indoor unit;

FIG. 6A is a front view of a heat exchanger of the indoor unit shown in FIG. 5;

FIG. 6B is an enlarged view of part of a heat radiating fin of the indoor unit shown in FIG. 5;

FIGS. 8 to 12 show a fifth embodiment of the present invention, in which

FIG. 8 is a longitudinal cross-sectional view of an indoor unit;

FIG. 11 is a perspective view of part of a crossflow fan of the indoor unit shown in FIG. 8;

FIG. 12 is a diagram for explaining a function of the cross-flow fan shown in FIG. 11 with respect to a heat exchanger;

DETAILED DESCRIPTION OF THE PREFERRED EMBODIMENT

A first embodiment of the present invention will be described with reference to FIGS. 1, 2A and 2B.

Figure 1:
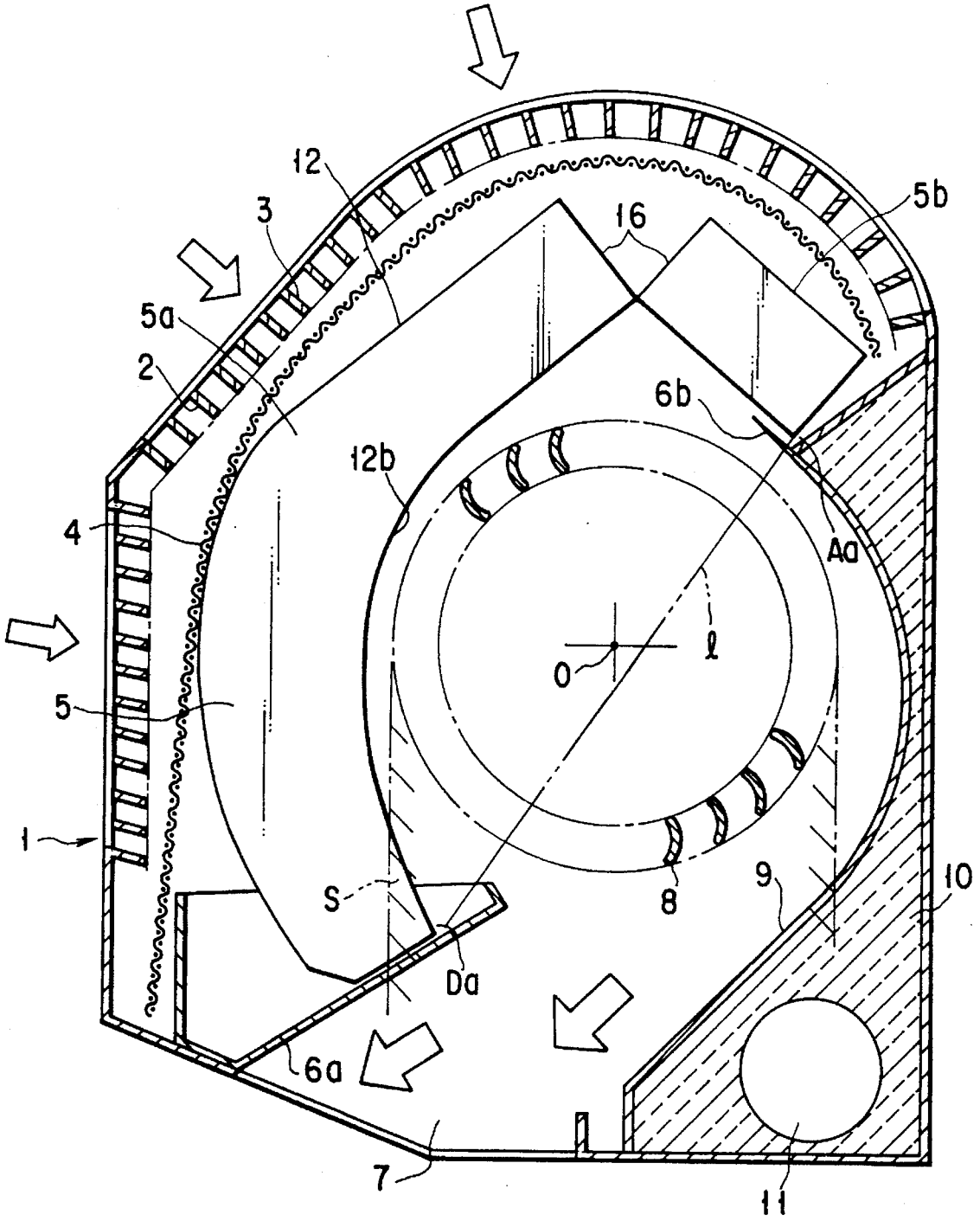

An indoor unit of an air conditioning machine is constructed as shown in FIG. 1.

An air inlet port 2 opens in a front portion of a unit body 1 and part of an upper portion thereof and a grill 3 is fitted in the air inlet port 2.

An air filter 4 and a heat exchanger 5 (described below) are provided, opposing to the air inlet port 2.

A front drain pan 6*a* is formed below a front lower portion of the heat exchanger 5 and a rear drain pan 6*b* is formed at the rear of the heat exchanger 5. The drain pans 6*a* and 6*b* communicate with each other through a passage (not shown). The outer bottom surface of the front drain pan 6*a* also serves as the nose of an air outlet port 7, which opens on a lower front portion of the unit body 1.

A cross flow fan 8, i.e., an air blowing fan of an indoor air blowing device, is arranged at the rear of the heat exchanger 5. A fan casing 9 is formed, ranging from an upper end portion of the heat exchanger 5 through the side of the cross flow fan 8 to the air outlet port 7.

A space between the fan casing 9 and the inner wall of the unit body 1 is filled with a heat insulating material 10. A hole 11, through which an auxiliary pipe, a drain hose and lead lines are to be inserted, is formed in part of the heat insulating material 10.

The heat exchanger 5 will now be described in detail.

Figure 2A:
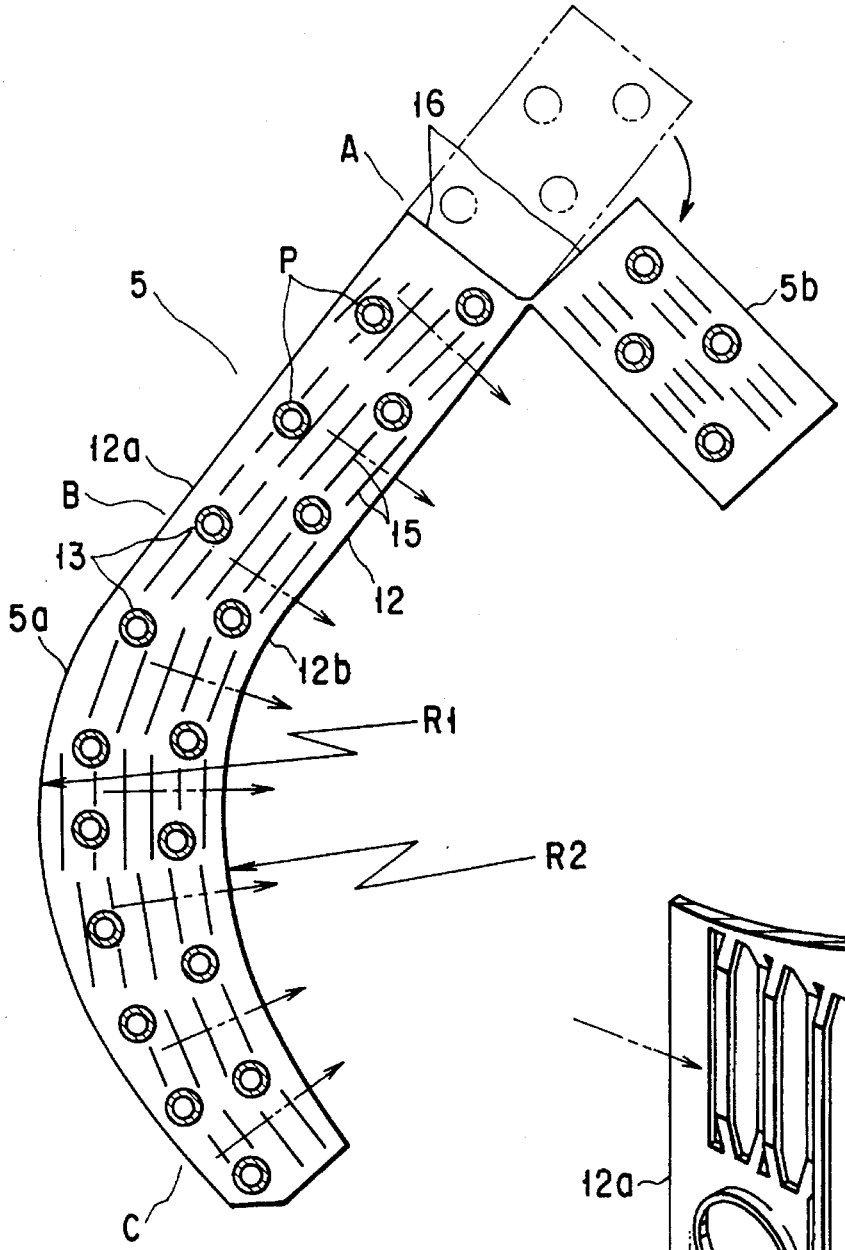

As shown in FIG. 2A, the heat exchanger 5 comprises heat radiating fins 12 and heat exchanging pipes P which are inserted through the heat radiating fins 12 and engaged with them.

The heat radiating fins 12 are arranged in a direction perpendicular to the drawing at small intervals therebetween. The heat exchanging pipes P are inserted through attachment holes 13 formed in the heat radiating fins 12 and engaged with them by pipe-expanding means.

Each of the heat exchanging pipes P is bent like a U-shape. One end of the pipe, projecting through the heat radiating fin, is bent like a U-shape, and the other end projecting through the heat radiating fin is opened.

The opened ends of two adjacent heat exchanging pipes P are connected with a U bend (not shown). In this manner, all the heat exchanging pipes P of the heat exchanger 5 are connected one another, thereby forming one flow passage.

The heat radiating fin 12 is formed in advance by a press-punching process, and has a straight upper end portion inclined at an angle in FIG. 1 and a U-shaped curved portion extending under the upper end portion.

Side edges 12*a* and 12*b* of the heat radiating fin 12 are straight and parallel with each other in a region between an upper portion A and a central portion B. However, in a region between the central portion B and a lower portion C, a curvature R1 of one side edge 12*a* is different from a curvature R2 of the other side edge 12*b*.

Thus, that region between the central portion B and the lower portion C is curved and substantially U-shaped.

A cut 16, extending from one side edge 12*a* to the proximity of the other side edge 12*b*, is formed in a predetermined portion of the upper portion A.

When the heat exchanger 5 is to be assembled, a portion above the cut 16 is rotated clockwise, i.e., from the position indicated by the two-dot-and-dash line shown in FIG. 2A to the position indicated by the solid line. Thus, part of the heat exchanger 5 is bent backward at an acute angle, i.e., in an inverted V-shape.

Since the bent portion A, located above the cut 16, is positioned in the rear side of the unit body 1, it is referred to as a rear side heat exchanger 5*b*. The portion under the cut 16, located in the front side of the unit body 1, is referred to as a front side heat exchanger 5*a*.

Most part of the front side heat exchanger 5*a* is curved in a U-shape, while the upper portion thereof is straight.

A number of raised slits 15 are formed in the heat radiating fin 12. As shown in FIG. 2B, parallel cuts are formed in the heat radiating fin 12 and portions between two adjacent cuts are raised so as to project forward and backward.

Figure 2B:
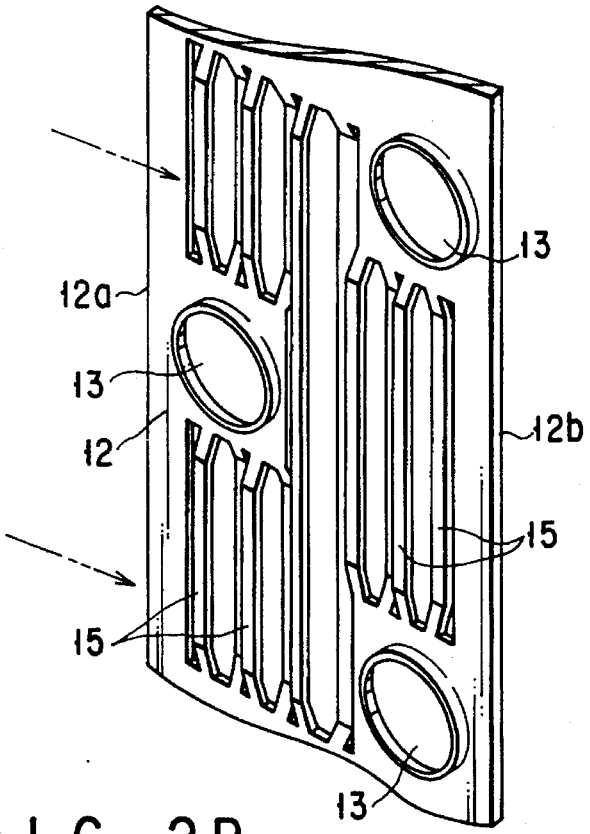

The raised slits 15 are set perpendicular to the flow of the heat-exchanged air, as indicated by the two-dot-and-dash line in FIG. 2B.

The heat exchanger 5 thus constructed is arranged at a predetermined position of the unit body 1, as shown in FIG. 1. The lower end of the front side heat exchanger 5*a* is positioned on the front drain pan 6*a* and the lower end of the rear side heat exchanger 5*b* is positioned on the rear drain pan 6*b*.

The aforementioned inverted V-shaped portion formed by the upper portions of the front and rear side heat exchangers 5*a* and 5*b* is located above a central axis 0 of the cross flow fan 8, so that these heat exchangers lie over the cross flow fan 8.

Further, since the cross flow fan 8 is located at the rear of the substantially U-shaped front side heat exchanger 5*a*, the front side heat exchanger 5*a* surrounds part of the circumferential surface of the cross flow fan 8.

Figure 16:
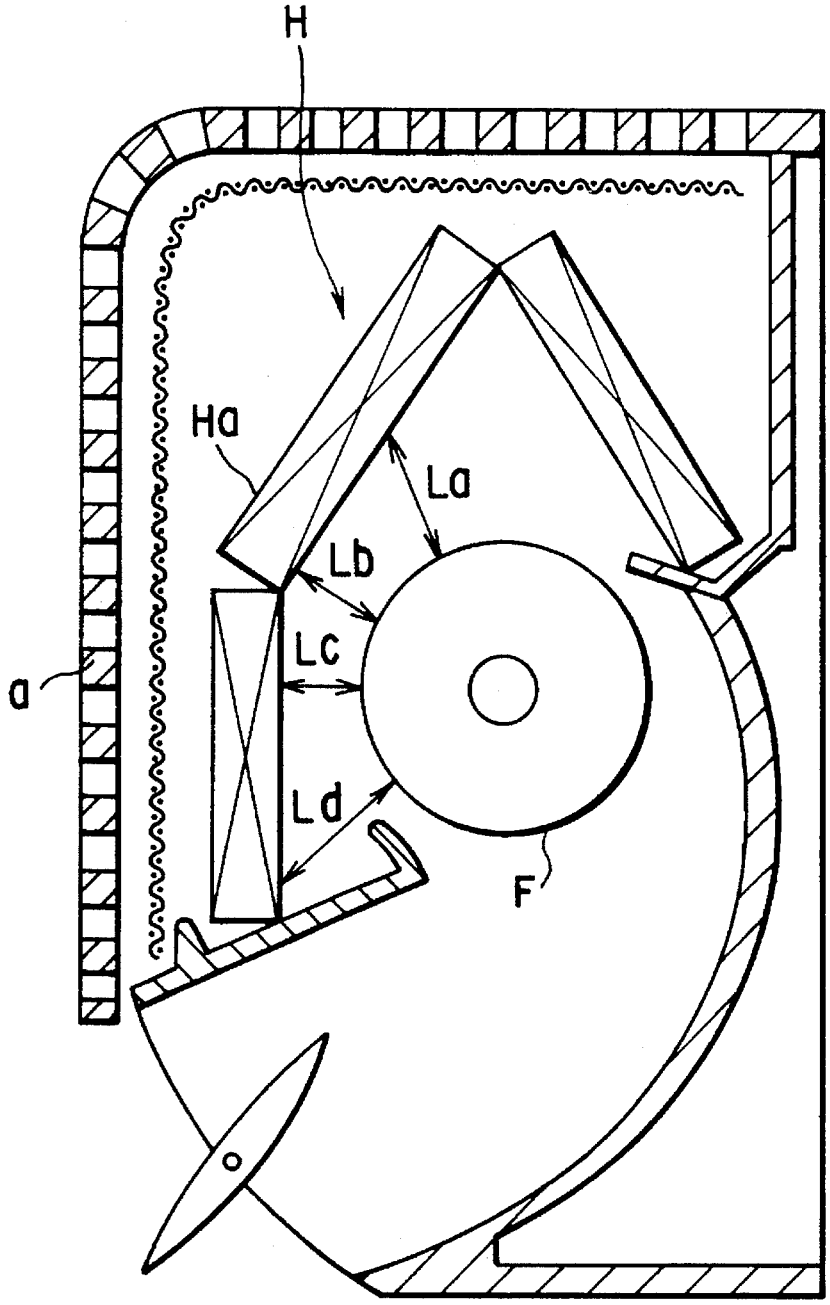
PRIOR ART FIG. 16
FIG. 16 is a longitudinal cross-sectional view of a conventional indoor unit.

The distance between the circumferential surface of the cross flow fan 8 and the rear side edge 12*b* of the front side heat exchanger 5*a* gradually increases and decreases. The variance in distance is much smaller than that in the conventional apparatus (e.g., the apparatus disclosed in Jpn. UM Appln. KOKAI Publication No. 4-68921 shown in FIG. 16).

A lower end portion Da of the front side heat exchanger 5*a*, bending along the cross flow fan 8, is located under the cross flow fan 8 in a plane S of projection indicated by a two-dot-and-dash line shown in FIG. 1.

Further, as shown in FIG. 1, a line l connecting the lower end portion Da of the front side heat exchanger 5*a* and a lower end portion Aa of the rear side heat exchanger 5*b* is located outward in respect of the central axis O of the cross flow fan 8. In other words, the overall heat exchanger 5 has a shape which sufficiently bends around the circumferential surface of the cross flow fan 8.

The indoor unit thus constructed performs, for example, a heating operation.

In a heating operation, a compressor of an outdoor unit (not shown) is driven to perform a refrigerating cycle operation. In the indoor unit, the cross flow fan 8 is driven. A refrigerant at a high temperature and a high pressure, discharged from the compressor, is introduced to the heat exchanger 5 serving as a condenser.

Air to be heat-exchanged, i.e., air in the room to be air-conditioned, is introduced through the inlet port 2 and supplied to the heat exchanger 5 through the air filter 4.

The air is caused to flow from side edges 12*a* of the heat radiating fin 12 through the gap between the heat radiating fins 12, brought into contact with the heat radiating fins 12 and the heat exchanging pipe P, and then, discharged through the other side edges 12*b*.

The refrigerant introduced to the heat exchanger 5 radiates heat of condensation, while passing through the heat exchanging pipes P. The heat of condensation is transferred to the heat radiating fins 12.

The air to be heat-exchanged, flowing through the heat radiating fins 12, performs a heat exchanging operation, in which the air to be heat-exchanged absorbs the heat, and the heated air is discharged from the heat exchanger 5 and blown out to the room through the cross flow fan 8. The room is thus heated.

Since the front and rear side heat exchangers 5*a* and 5*b* in the heat exchanger 5 form an inverted V shape, the heights of the heat exchanger 5 and the unit body 1 can be reduced. This contributes to the reduction of the space required for the air conditioner.

In addition, since the front side heat exchanger 5*a* is substantially U-shaped so as to surround part of the circumferential surface of the cross flow 8, the distance between the heat exchanger 5*a* and the circumferential surface of the cross flow fan 8 varies very little.

Hence, the pressure and amount of inlet air to be heat-exchanged are constant, thereby reducing the sound of blowing air and improving the heat-exchanging efficiency.

Furthermore, the lower end portion Da of the front side heat exchanger 5*a* is located under the cross flow fan 8 in the plane S of projection, and the line l connecting the lower end portion Da and the lower end portion Aa of the rear side heat exchanger 5*b* is located outward in respect of the central axis O of the cross flow fan 8. Since the overall heat exchanger 5 thus sufficiently bends around the circumferential surface of the cross flow fan 8, the distance between the heat exchanger 5 and the circumferential surface of the cross flow fan 8 varies very little. Accordingly, non-uniformity in heat exchanging efficiency of the heat exchanger 5 is prevented.

Figure 3:
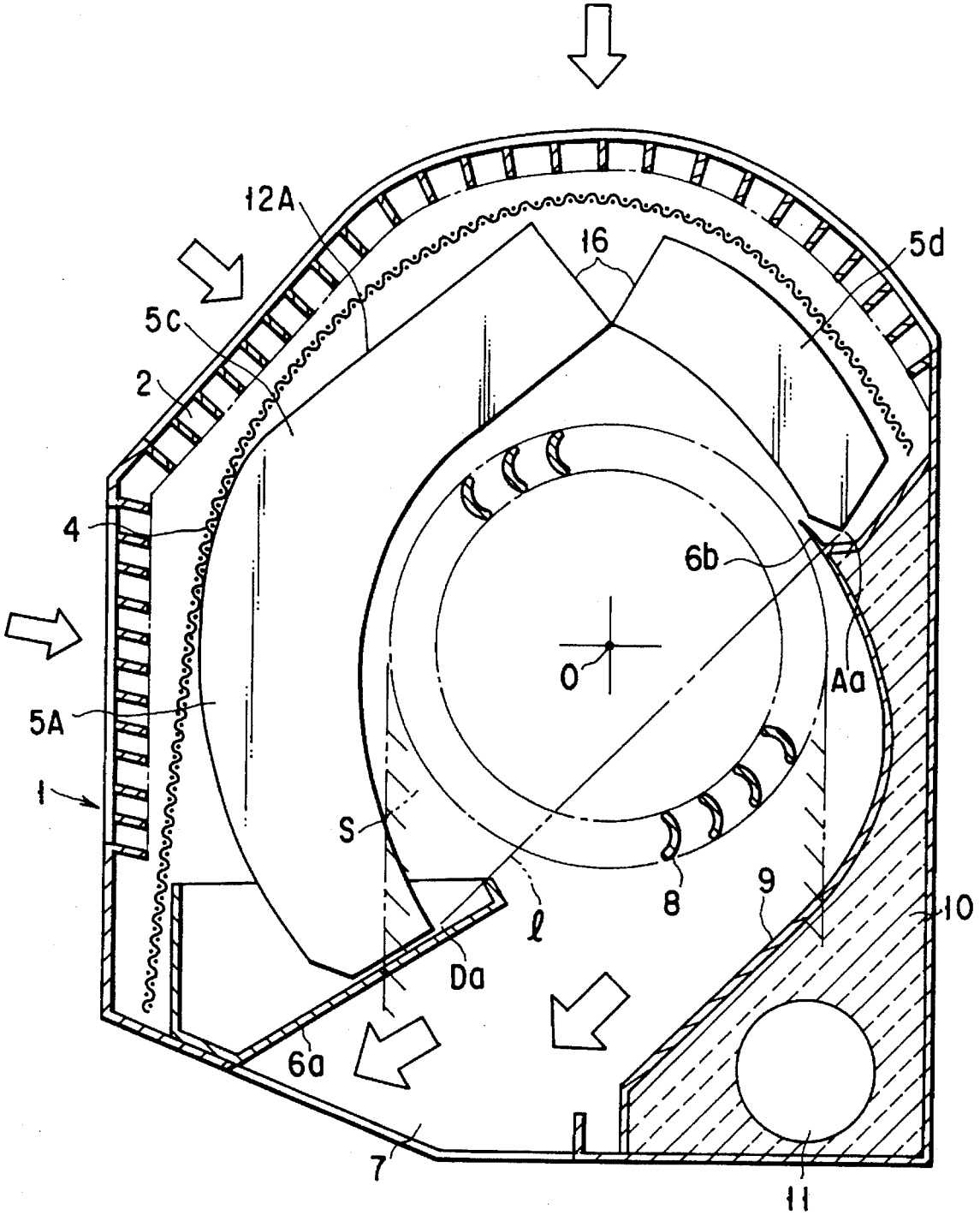
FIG. 3 is a longitudinal cross-sectional view of an indoor unit according to a second embodiment of the present invention.

Since each of the heat radiating fins 12 is formed in advance by a press-punching process, the front side heat exchanger 5*a*, which is particularly complex, can be easily obtained without an additional artificial process, such as cutting or notching. Moreover, since cut and notch scraps resulting from the artificial process are not produced, the process of manufacturing the heat exchanger 5 of this embodiment is economically advantageous. FIG. 3 shows an indoor unit comprising a heat exchanger 5A according to a second embodiment of the present invention.

In this case, since the structure of the indoor unit is completely the same as that of the first embodiment, except for a heat exchanger 5A (described below), the same elements as in the first embodiment are identified with the same reference numerals and descriptions thereof are omitted.

Each of heat radiating fins 12A constituting the heat exchanger 5A has a curved portion above a cut 16. The heat radiating fin 12A is bent at the cut 16, so as to form a front side heat exchanger 5*c* and a rear side heat exchanger 5*d*, which constitute an inverted v-shaped heat exchanger 5A.

Since the rear side heat exchanger 5*d* is curved, the heat exchanging area is increased as compared to the straight rear side heat exchanger 5*b* as described above. In addition, all the drain water generated in the rear side heat exchanger 5*d* drops in the rear drain pan 6*b*, i.e., none of the drain water drops on the cross flow fan 8.

The heat radiating fin 12A is in the same conditions as in the above embodiment shown in FIG. 1, i.e., the front side heat exchanger 5*c*, which is formed in advance by a press-punching process, is curved in a U-shaped; the lower end portion Da of the front side heat exchanger 5*c* is located under the cross flow fan 8 in the plane S of projection; and the line l connecting the lower end portion Da of the front side heat exchanger and the lower end portion Aa of the rear side heat exchanger 5*d* is located outward in respect of the central axis O of the cross flow fan 8. Therefore, the same advantages as in the above embodiment can be obtained.

Figure 4:
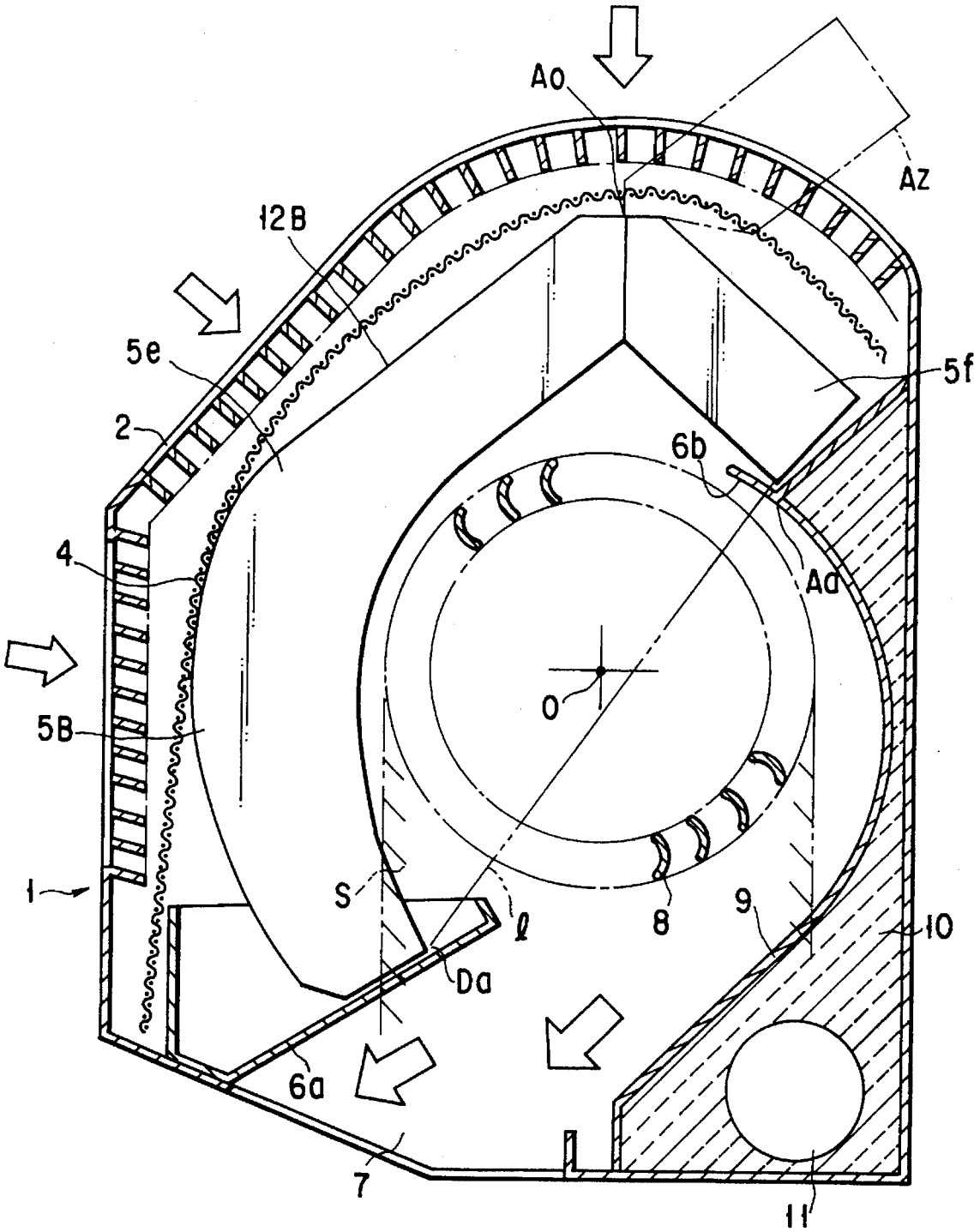
FIG. 4 is a longitudinal cross-sectional view of an indoor unit according to a third embodiment of the present invention.

FIG. 4 shows an indoor unit comprising a heat exchanger 5B according to a third embodiment of the present invention.

In this case, since the structure of the indoor unit is completely the same as that of the above embodiments, except for the heat exchanger 5B (described below), the same elements as in the above embodiments are identified with the same reference numerals and descriptions thereof are omitted.

In each of heat radiating fins 12B constituting the heat exchanger 5B, end faces forming an inverted V shape are connected to each other, i.e., a space due to the cut 16 as described with reference to FIGS. 1 and 3 is not formed.

An upper portion Az is first connected to the heat radiating fin 12B via a connect portion A0, left between two cuts formed at an acute angle on both edge portions, as indicated by a two-dot-and-dash line shown in FIG. 4.

In this state, when the upper portion Az is bent so that end faces are brought into contact with each other, an inverted V-shaped heat exchanger 5B, consisting of a front side heat exchanger **5*e* and a rear side heat exchanger 5*f*** with no space interposed therebetween, is obtained.

Since the heat exchanging area of the heat exchanger 5B is increased, air introduced to this heat exchanger is subjected to sufficient heat exchange, thus improving the heat exchanging efficiency.

The heat exchanger is in the same conditions as in the above embodiments, except that the front side heat exchanger **5*e***, which is formed in advance by a press-punching process, is curved in a U-shaped. Therefore, the same advantages as in the above embodiments can be obtained.

Figure 5:
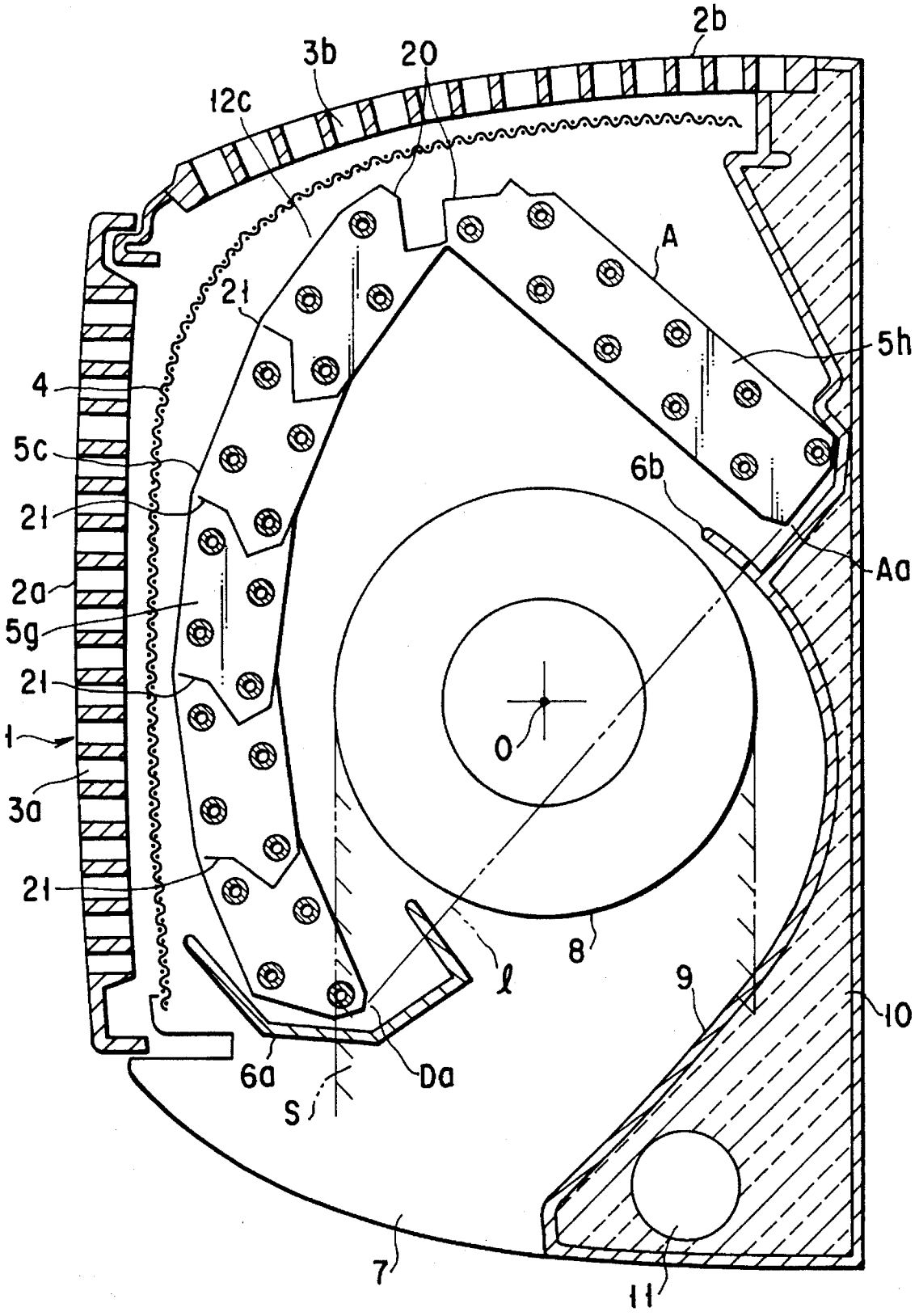

FIGS. 5, 6A and 6B show a fourth embodiment of the present invention.

FIG. 5 shows an indoor unit comprising a heat exchanger 5C according to the fourth embodiment.

The structure of the indoor unit is basically the same as that of the above embodiment, except for the heat exchanger 5C (described below), although there is a slight structural difference therebetween. That is, the indoor unit comprises an unit body 1, an air filter 4, a front drain pan **6*a*, a rear drain pan 6*b*, an air outlet port 7, a cross flow fan 8, i.e., an air blowing fan of an indoor air blowing device, a fan casing 9, a heat insulating material 10 and a hole 11. The air inlet port is constituted by a front inlet port 2*a* and a rear inlet port 2*b*, in which grills 3*a* and 3*b*** are fitted, respectively.

Each of heat radiating fins 12C constituting the heat exchanger 5C has a cut 20 on an air introducing side of its upper portion A.

The heat radiating fin 12C is bent at the cut 20, thereby forming an inverted V-shaped heat exchanger 5C consisting of a front side heat exchanger **5*g* and a rear side heat exchanger 5*h***.

A number of notch portions 21 are formed below the cut 20 at predetermined intervals therebetween in its longitudinal direction, from one side edge to the other.

The heat radiating fin 12 is bent at the notch portions 21, thereby forming a front side heat exchanger **5*g*** which is bent in a number of stages and substantially U-shaped.

FIG. 6A shows a heat radiating fin 12C, which has not yet been bent.

The heat radiating fin 12C is very narrow and long.

The heat radiating fin 12C has a number of attachment holes 22 through which heat exchanging pipes are inserted. The attachment holes 22 are arranged in two columns in a staggered fashion. Raised slits 23 are formed in the heat radiating fin 12C, as will be described later.

In an upper portion A of the heat radiating fin 12C, a zigzag cut 20 extends from the left side edge of the fin to a portion immediately before the right side edge thereof in FIG. 6A, i.e., from the air inlet side of the fin to a position in close proximity to the air outlet side thereof.

The notch portions 21 are formed at predetermined intervals below the cut 20 over a lower portion C. They extend from the right side edge of the fin to a portion immediately before the left side edge thereof in FIG. 6A, i.e., from the air outlet side of the fin to a position in close proximity to the air inlet side thereof. Upper and lower edges of each notch portion are shaped zigzag at different angles.

FIG. 6B is an enlarged view showing the notch portion 21 and its periphery.

The raised slits 23 are formed between the attachment holes 22 and along the upper end lower edges of the notch portion 21. Each slit is cut and raised from both surfaces of the fin and the raised portion is parallel to the fin surface.

The shape of the raised slits 23 formed between the notch portions 21 and between the attachment holes 22 is referred to as an A pattern; the shape of the raised slits formed along the lower edges of the notch portions 21 is referred to as a B pattern; and the shape of the raised slits formed along the upper edges of the notch portions is referred to as a C pattern.

The raised slits 23 of the above three patterns, formed in the heat radiating fin 12C, perform an efficient heat exchange with respect to air flowing through the slits.

Referring to FIG. 5 again, with the heat exchanger 5C having the heat radiating fin 12C as described above, the height of the air conditioner can be reduced. In addition, the distance between the front side heat exchanger **5*g* and the cross flow fan 8** can be uniform, thereby improving the heat exchanging efficiency.

The relationship between the heat exchanger 5C and the cross flow fan 8 is the same as in the aforementioned embodiments, i.e., the lower end portion Da of the front side heat exchanger **5*g* is located under the cross flow fan 8 in the plane S of projection; and the line l connecting the lower end portion Da of the front side heat exchanger 5*g* and the lower end portion Aa of the rear side heat exchanger 5*h* is located outward in respect of the central axis O of the cross flow fan 8**. Therefore, the same advantages as in the above embodiments can be obtained.

In the above embodiment, the cut 20 formed in the upper portion of the heat radiating fin 12C is bent; however, a notch portion can be provided instead of the cut to bend the fin. Further, the notch portions 21 can be replaced by cuts to form a substantially U-shaped portion of the fin.

Figure 7A:
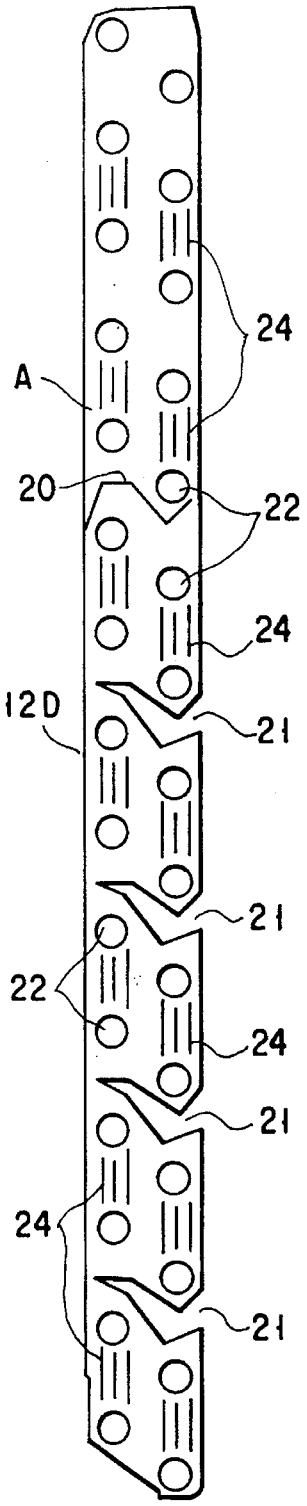
FIG. 7A is a front view of another heat radiating fin.
Figure 7B:
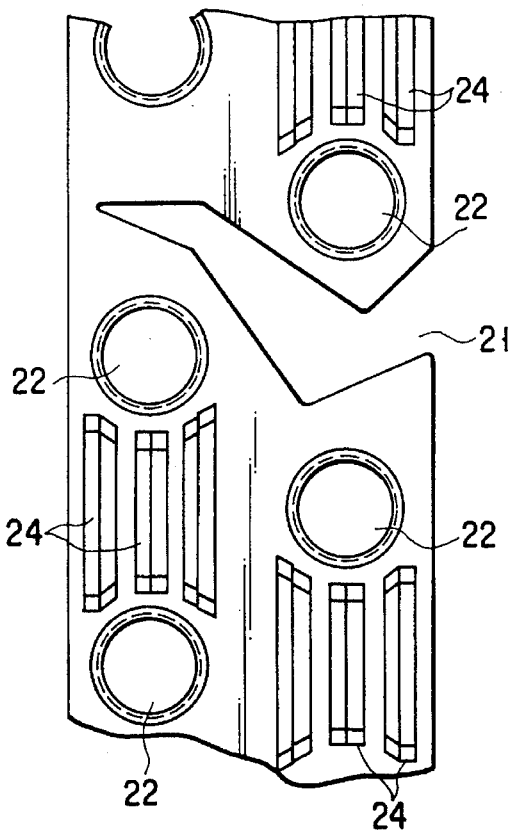
FIG. 7B is an enlarged view of part of the heat radiating fin.
Figure 7C:
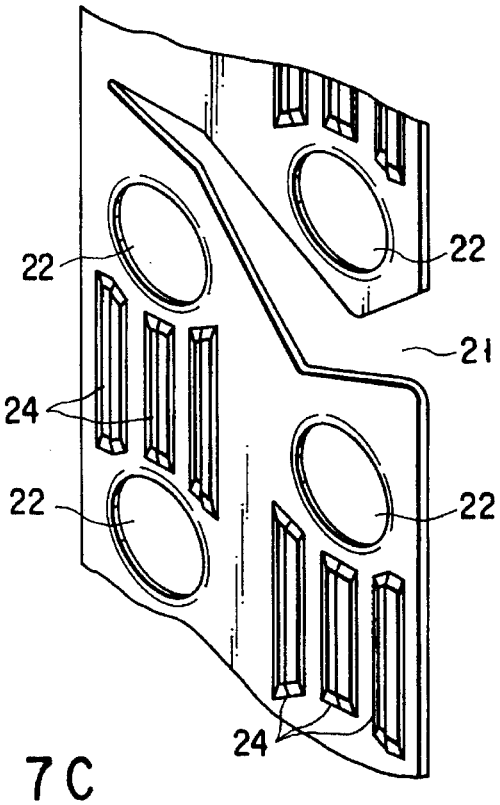
FIG. 7C is a perspective view of the heat radiating fin.

It is possible to use a heat radiating fin 12D as shown in FIGS. 7A, 7B and 7C. The overall shape, the cut 20, the notch portions 21 and the attachment holes 22 are the same as those shown in FIGS. 6A and 6B.

Raised slits 24 are formed in every other space between adjacent upper and lower attachment holes 22 in an upper portion A above the cut 20 and in every space between adjacent upper and lower attachment holes between the notch portions.

Three slits 24, arranged side by side in the width direction of the fin 12D, constitute a set. Each slit is constituted by a pair of cut pieces raised from both sides of the fin 12D. The faces of the cut pieces are parallel to the fin surface.

An inverted V-shaped portion is formed by bending the aforementioned fin 12D at the cut 20 as shown in FIG. 5. A substantially U-shaped portion is formed by bending the notch portions 21.

Further, in this heat radiating fin 12D, since raised slits are not formed on both the upper and lower sides of the cut 20 and both the upper and lower sides of each notch portion 21, the rigidity of the fin 12 near the cut and notch portions can be maintained.

Since the fin 12D is bent at the cut 20 and the notch portions 21, the distance between the heat exchanging pipes on both sides of a bent portion is smaller than that between the heat exchanging pipes in an unbent portion.

The difference in distance results in a difference in ventilation resistance with respect to air flowing through the heat exchanger. It is natural that the shorter the distance, the greater the ventilation resistance. The shorter distance portions correspond to the bent portions.

However, since raised slits are not formed in the bent portions, the ventilation resistance in the bent portions is substantially the same as that in the portions in which the raised slits 24 are formed. Thus, the heat exchanging efficiency can be uniform.

Figure 8:
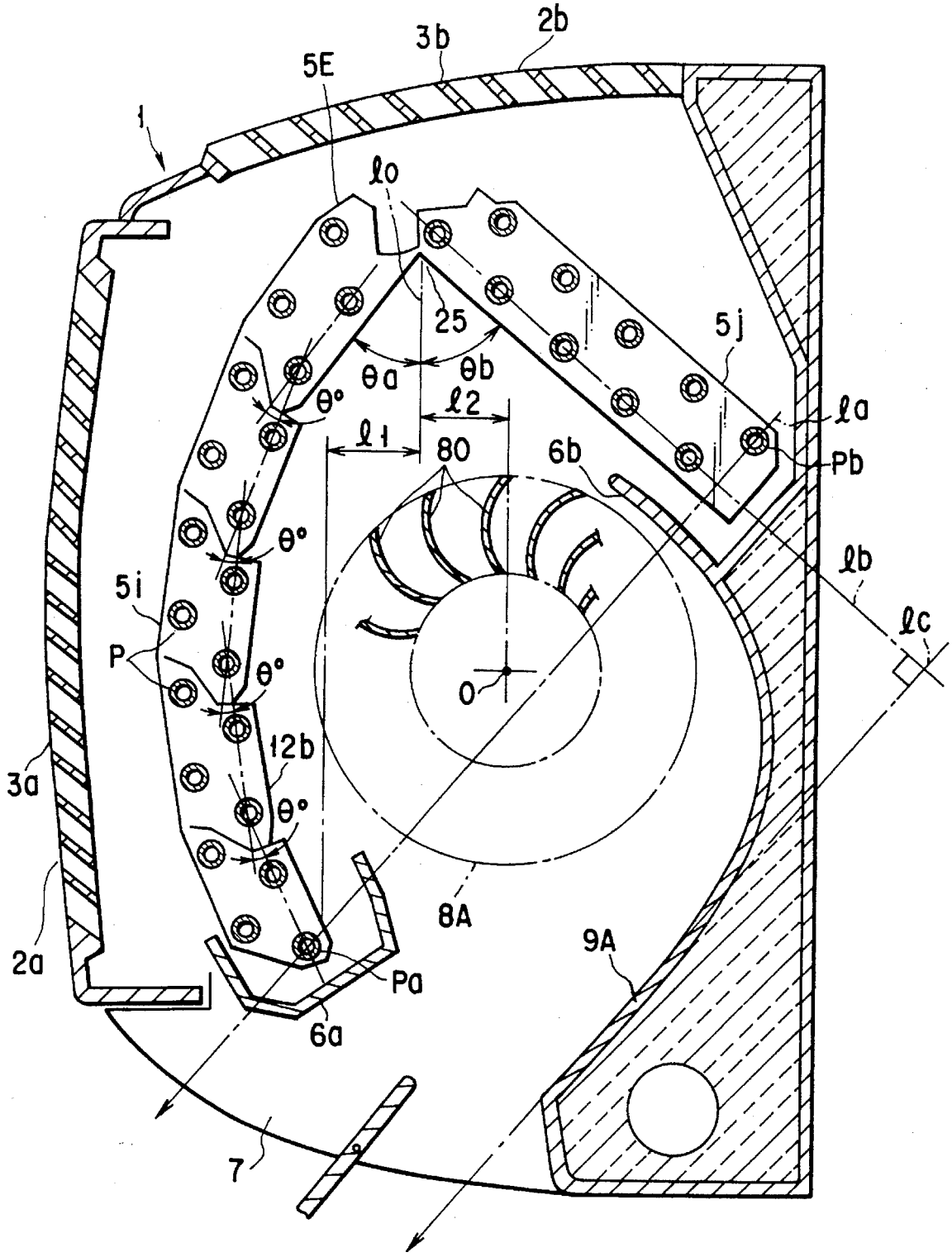

FIG. 8 shows an indoor unit of the air conditioning machine according to a fifth embodiment of the present invention.

A unit body 1 has a front inlet port 2*a*, in which a grill 3*a* is fitted, and an upper inlet port 2*b*, in which a grill 3*b* is fitted.

An air outlet port 7 is formed in a region from a front portion of the unit body 1 to the bottom thereof. An air filter (not shown) is formed opposing to the front and upper inlet ports 2*a* and 2*b* above the air outlet port 7. A heat exchanger 5E and a cross flow fan 8A are arranged inside the filter.

Figure 9A:
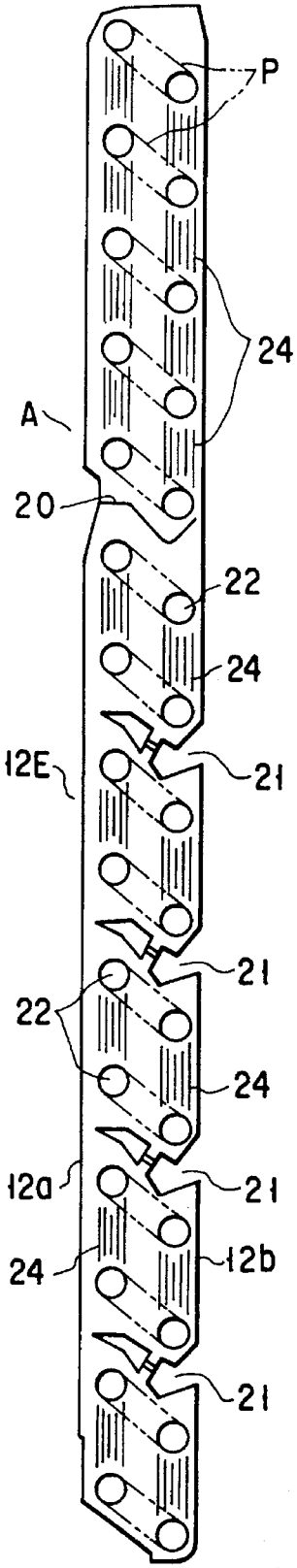
FIG. 9A is a front view of a fin used in a heat exchanger of the indoor unit shown in FIG. 8.
Figure 9B:
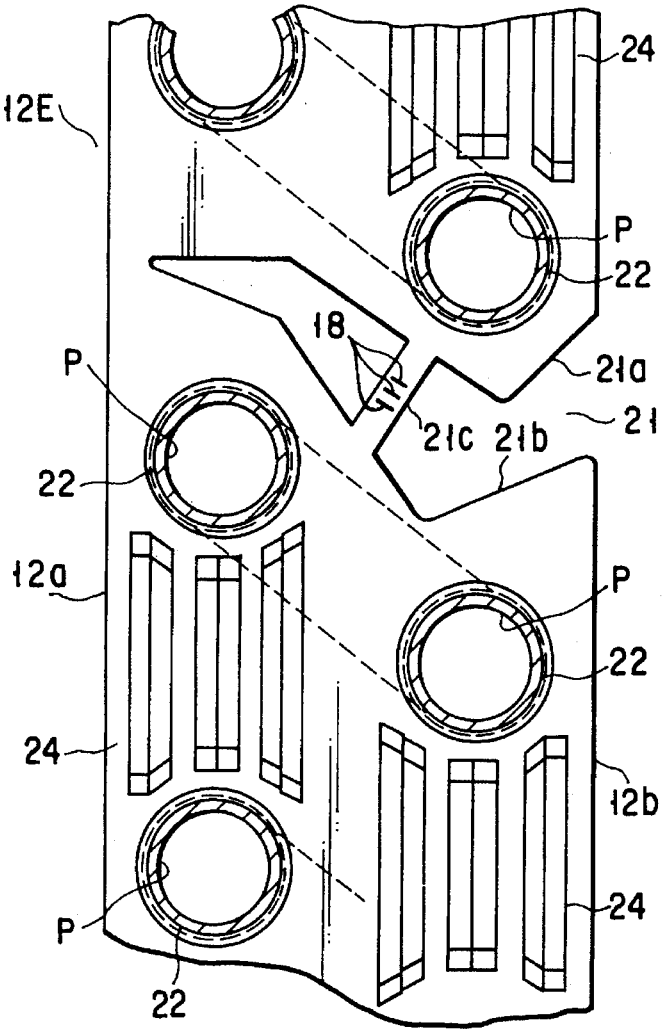
FIG. 9B is an enlarged view of part of a heat radiating fin of the indoor unit shown in FIG. 8.

The heat exchanger 5E is made up of heat radiating fins 12E as shown in FIGS. 9A and 9B.

Each of the heat radiating fins 12E is very narrow and long. The heat radiating fins 12E are arranged in a direction perpendicular to the drawing at small intervals. Each fin has a plurality of attachment holes 22 arranged in two columns in a staggered fashion in the drawing. The heat exchanging pipes P are inserted through the attachment holes and engaged with them.

The heat radiating fin 12E is formed in advance by a press-punching process. It has a cut 20 extending horizontally in a region between one edge 12*a* and in a middle portion and v-shaped from the middle portion to a portion immediately before the other edge 12*b*.

A plurality of notch portions 21 are formed below the cut 20 at intervals.

Each of the notch portions 21 is defined by an upper edge 21*a* and a lower edge 21*b*. Each of the edges has zigzag sides bent in different directions. The top end of the notch 21 is ranging to a portion immediately before the edge 12*a*.

A bridge 21*c* is formed integral with the fin 12E in a middle portion of each notch portion 21. The bridge 21*c* is a narrow arm connecting middle portions of the upper and lower edges 21*a* and 21*b* and forms predetermined angles with respect to the edges 12*a* and 12*b*.

Figure 9C:
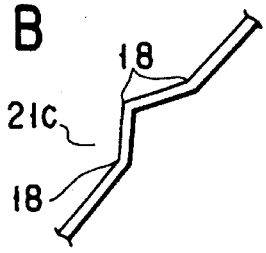
FIG. 9C is a side view of a bridge section of the heat radiating fin.

AS shown in FIG. 9C, a middle portion of the bridge 21*c* is bent to project in one direction so as to form a triangular cross section, and folds 18 are formed at top and base portions of the triangle.

Referring to FIGS. 9A and 9B again, raised slits 24 are formed between adjacent upper and lower attachment holes 22, except for the space between the attachment holes 22 on the upper and lower sides of the cut 20 and the space between the attachment holes 22 on the upper and lower sides of each of the notch portions 21.

Each of the raised slits 24, extending in the longitudinal direction of the fin 12E, is formed of raised pieces cut from the fin and raised from both surfaces thereof. The raised slits 24 can thus be efficiently brought into contact with air to be heat-exchanged, which is flowing along the both surfaces of the fin.

A U-shaped heat exchanging pipe P is inserted through adjacent attachment holes 22 on the right and left columns formed in the heat radiating fins 12E and engaged with them by pipe-expanding means.

More specifically, as indicated by a two-dot-and-dash line in FIG. 9A, the U-shaped heat exchanging pipe P is inserted through adjacent attachment holes on the right and left columns in the region between the upper end of the heat radiating fin 12E and the cut 20, the region between the cut 20 and the uppermost notch portion 21, the region between adjacent notch portions and the region between the lower most notch portion and the lower end of the heat radiating fin 12E. In other words, the U-shaped heat exchanging pipe is never laid over the cut 20 or the notch portion 21.

In this state, a straight plate-like heat exchanger is formed, and thereafter it is bent at the cut 20 and the notch portions 21.

The heat radiating fin 12E is bent inward at the cut and the notch portions by applying force in a direction from the edge 12*a* toward the other edge 12*b* of the heat radiating fin 12E.

Figure 10A:
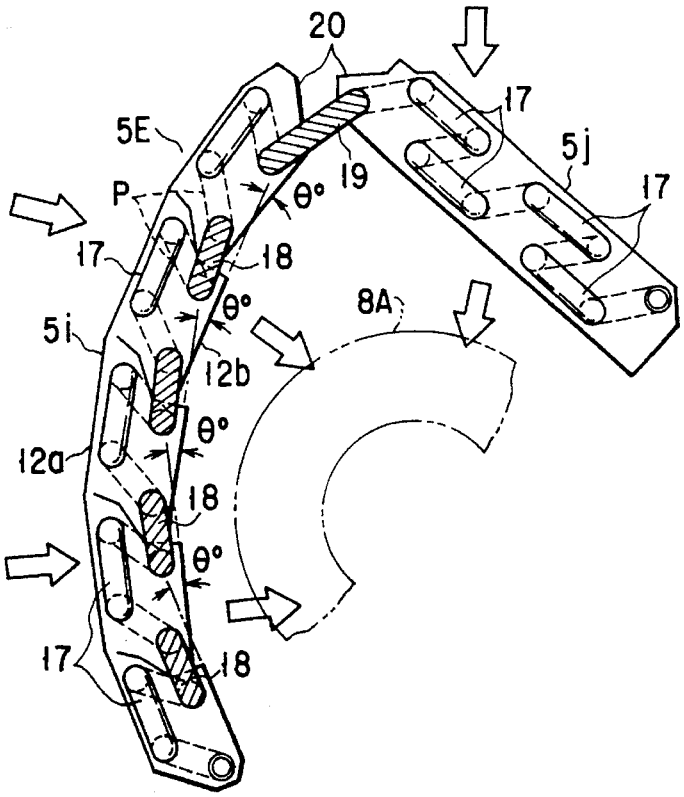
FIG. 10A is a cross-sectional view of the heat exchanger of the indoor unit shown in FIG. 8.
Figure 10B:
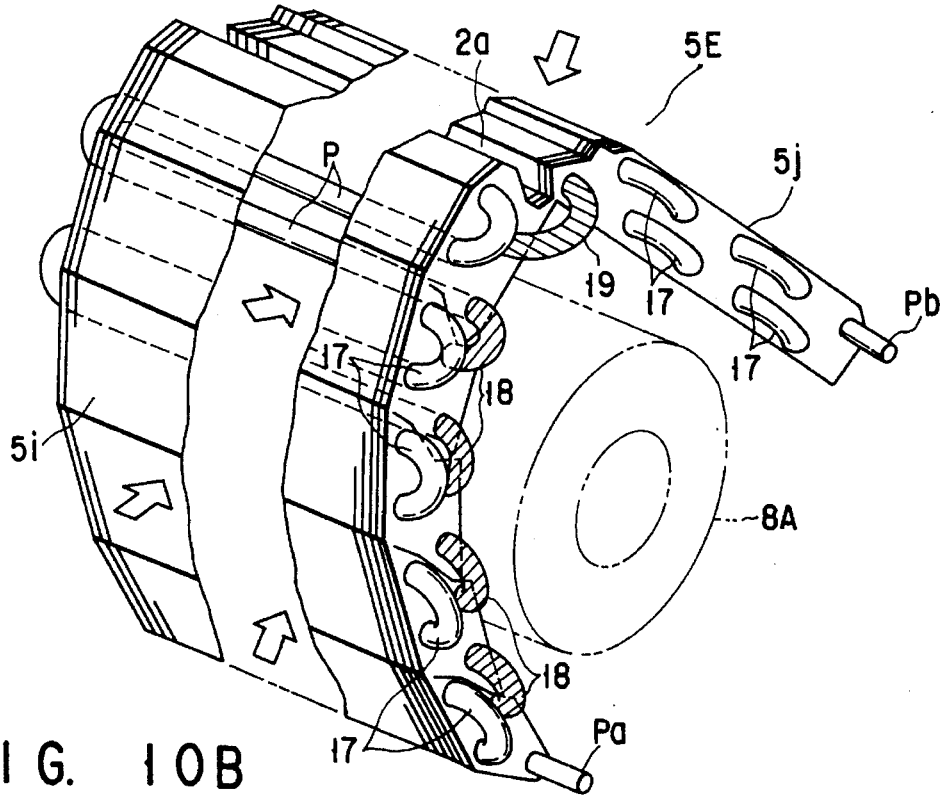
FIG. 10B is a perspective view of part of the heat exchanger of the indoor unit shown in FIG. 8.

As shown in FIGS. 10A and 10B, the heat radiating fin 12E is bent backward at the cut 20 at an acute angle, thereby forming an inverted V-shaped heat exchanger 5E having a front side heat exchanger 5*i* and a rear side heat exchanger 5*j*.

Further, the front side heat exchanger is bent at the aforementioned notch portions 21, so that the upper and lower edges 21*a* and 21*b* of each notch portion 21 are brought into contact with each other. The heat exchanging sections above and below each notch portion 21 are bent inward.

In this state, the bridges 21*c* formed in the notch portions 21 are folded along the folds 18 so as to project in one direction, thereby maintaining the rigidity around the notch portions 21.

With the above structure, all the notch portions 21 of the front side heat exchanger 5*i* are bent at the same angle of θ.

Finally, the openings of adjacent heat exchanging pipes P are connected by U bends 17 to 19 (to be described below).

In the front side heat exchanger 5*i*, U bends 17 are provided on the left column and U bends 18 are provided on the right column in FIG. 10. The adjacent U bends 17 and 18 are parallel to each other.

The left side U bends 17 are located on the air introducing side and the right side U bends 18 are located on the air discharging side of the front side heat exchanger 5*i*.

The left side U bends 17 for connecting adjacent upper and lower openings of the heat exchanging pipes P are regular type U bends, which have conventionally been used, since the distance between the openings remains unchanged before and after the process of bending the heat exchanger.

The right side U bends 18 (hatched in FIGS. 10A and 10B) for connecting adjacent upper and lower openings of the heat exchanging pipes P are formed in accordance with the distance between the openings of the heat exchanging pipes in the state where the cut portions 21 have been bent, and connect the openings.

Each of the U bends 18 is laid across the bent notch portion 21. If the bend angle θ is determined, the distance between the openings of the heat exchanging pipes P on both sides of the notch portion 21 can also be determined. In other words, the U bends 18 on the right column are formed in accordance with the bend angle θ and connected with the heat exchanging pipes P.

The U bend 19, provided on the right column, is also formed in accordance with the bend angle θ and connected with the heat exchanging pipes P.

The U bends 17 in the rear side heat exchanger 5*j* are conventional regular type U bends, since the distance between the openings of the heat exchanging pipes P remains unchanged, due to its structure, before and after the process of bending the heat exchanger.

In this manner, a single passage is constituted by the heat exchanging pipes P the U bends 17 to 19 through the inverted V-shaped heat exchanger 5E.

Referring to FIG. 8 again, the overall heat exchanger 5E is inverted V-shaped. The front side heat exchanger 5*i* is bent in stages at the same angle of θ, with the edge 12*b* being directed inward, to form a curve. In contrast, the rear side heat exchanger 5*j* is straight and rectangular.

The ratio of the area of the front side heat exchanger 5*i* to that of the rear side heat exchanger 5*j* should be at least 2:1. It is preferable that the area of the front side heat exchanger 5*i* is twice or greater than that of the rear side heat exchanger 5*j*.

An angle $\theta_a$ formed between the right edge of the uppermost portion of the front side heat exchanger 5*i* and a vertical line $l_0$ passing through a connect portion 25 between the front and rear side heat exchangers 5*i* and 5*j* is more acute than an angle $l_a$ formed between the left edge of the rear side heat exchanger 5*j* and the vertical line $l_0$.

In other words, the uppermost portion of the front side heat exchanger 5*i* is inclined steep and the rear side heat exchanger 5*j* is inclined gently.

The lower end of the front side heat exchanger 5*i* is located $l_1$ forward in respect of the connect portion 25.

End plates (not shown) is attached to both ends of the heat exchanger 5E. The heat exchanger 5E is arranged in a predetermined portion of the unit body 1 by means of the end plates. A front drain pan 6*a* is formed under the lower end of the front side heat exchanger 5*i* and a rear drain pan 6*b* is formed under the lower end of the rear side heat exchanger 5*j*.

The drain pans 6*a* and 6*b* communicate with each other through a passage (not shown), so that drainage collected in the rear drain pan 6*b* flows to the front drain pan 6*b* through the passage.

A cross flow fan 8A, i.e., an air blowing fan of an indoor air blowing device, is arranged at the rear of the heat exchanger 5*i*. The cross flow fan 8A has a number of blades 80 arranged in a circumferential direction and its cross section is circular.

Figure 11:
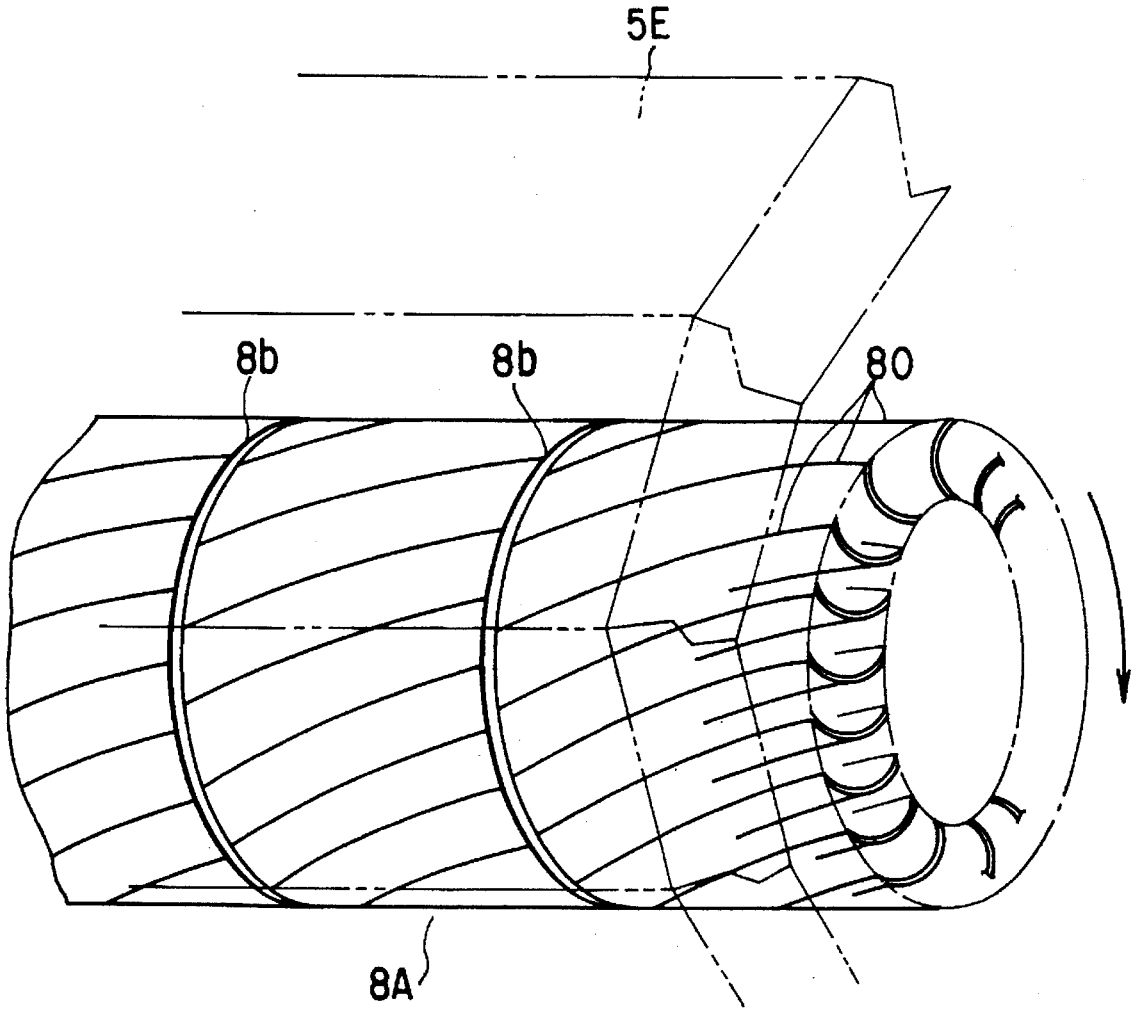

As shown in FIG. 11, the blades 80 are provided between partitioning plates 8*b* arranged at intervals in the axial direction of the cross flow fan 8A.

The cross flow fan is a skew type fan in which the blades 80 are twisted so as to have an angle of sweepforward with respect to a direction of rotation.

Referring to FIG. 8 again, the cross flow fan 8A is located at the rear of the front side heat exchanger 5*i* and part of the circumferential surface thereof is surrounded by the front side heat exchanger with a gap therebetween. The distance between the circumferential surface and the rear surface of the front side heat exchanger gradually increases and decreases. The variance in distance is much smaller than that in the conventional apparatus (e.g., the apparatus disclosed in Jpn. UM Appln. KOKAI Publication No. 4-57073).

The connect portion 25 between the front side heat exchanger 5*i* and the rear side heat exchanger 5*j* is located $l_2$ forward in respect of the central axis O of the cross flow fan 8A.

A line $l_a$ connecting the lowermost heat exchanging pipe Pa of the front side heat exchanger 5*i* and the lowermost heat exchanging pipe Pb of the rear side heat exchanger 5*j* is located outward in respect of the central axis O of the cross flow fan 8A. The line $l_a$ crosses a prolongation $l_b$ of the rear side heat exchanger 5*j* at right angles.

A fan casing 9A is formed, ranging from the bottom portion of the rear drain pan 6*b* through the side of the cross flow fan 8A to an air outlet port 7. A tangent line $l_c$ in contact with a lower portion of the air outlet port 7 of the casing 9A crosses the extension line $l_b$ of the rear side heat exchanger 5*j* at right angles. The tangent line $l_c$ in contact with the lower portion of the air outlet port 7 of the casing 9A is parallel with the line $l_a$ connecting the lowermost heat exchanging pipe Pa of the front side heat exchanger 5*i* and the lowermost heat exchanging pipe Pb of the rear side heat exchanger 5*j*.

With the above indoor unit, since the front and rear side heat exchangers 5*i* and 5*j* in the heat exchanger 5E form an inverted V shape, the heights of the heat exchanger 5 and the unit body 1 can be reduced. This contributes to the reduction of the space required for the air conditioner.

Since the front side heat exchanger 5*i* is bent at a plurality of portions, the heat exchanger 5*i* surrounds part of the circumferential surface of the cross flow fan 8A, so that the difference between the maximum and minimum distances between the heat exchanger 5*i* and the cross flow fan 8A can be very small.

The front side heat exchanger 5*i* allows passage of a greater amount of air as compared to the rear side heat exchanger 5*j*. Therefore, since the pressure and amount of air to be heat-exchanged, taken in by the heat exchanger 5E as a whole, are quite constant, the sound of blowing air is reduced and the heat-exchanging efficiency is improved.

Further, since the notch portions 21 of the front side heat exchanger 5*i* have the same shape and bend at the same angle θ, the ventilation resistances of the air to be heat-exchanged, passing through the bent portions, are the same, and the pressure and amount of air to be heat-exchanged are constant. Thus, the sound of blowing air is much reduced and the heat exchanging efficiency is further improved.

The amount of air passing through the front inlet port 2*a* is greater than that of air passing through the upper inlet port 2*b*, on account of their areas and positions.

As regards the heat exchanging performances of the front and rear side heat exchangers 5*i* and 5*j*, respectively opposing to the inlet ports 2*a* and 2*b*, the heat exchanging performance of the front side heat exchanger 5*i* is greater than that of the rear side heat exchanger 5*j*, on account of their structure and the amount of air passed through the heat exchangers.

Therefore, the amount of drainage produced in the front side heat exchanger 5*i* during a cooling operation is greater than that in the rear side heat exchanger 5*j*.

Since the inclination angle $\theta_a$ of the front side heat exchanger is steep, the produced drainage immediately flows down along the steeply inclined plane and collects in the front drain pan 6*a*.

In other words, the drainage does not drop from a middle portion of the front side heat exchanger 5*i*, due to the steep angle of the front side heat exchanger 5*i*, it does not wet the interior of the unit body 1 or discharged into the room along with air blown by the cross flow fan.

Drainage is also generated in the rear side heat exchanger **5*j*, but the amount thereof is very little, due to the amount of the air introduced thereto and the area of the heat exchanger 5*j***.

Therefore, although the inclination angle $\theta_b$ is relatively gentle, all the drainage is collected in the rear drain pan **6*b*** without a drop from the middle portion thereof.

Thus, a sufficient space for the cross flow fan 8A is maintained between the front side heat exchanger **5*i* and the rear side heat exchanger 5*j*, the inclination angles of which are set to ensure that the drainage is collected without dropping. This contributes to reduce the height of the unit body 1**.

Further, since the ratio of the area of the front side heat exchanger **5*i* to that of the rear side heat exchanger 5*j* is set to at least 2:1, a greater amount of drainage is generated in the front side heat exchanger 5*i* having the greater area. It is preferable that the area of the front side heat exchanger 5*i* be twice or greater than that of the rear side heat exchanger 5*j***, so that a more remarkable effect can be obtained.

Furthermore, if the ventilation resistance of air through the bent portion is set equal to that of the adjacent raised slit 24, the ventilation resistances in all the portions of the front side heat exchanger **5*i*** can be the same. Therefore, the sound of blowing air is much reduced and the heat exchanging efficiency is further improved.

Since the bend angles of the bent portions of the front side heat exchanger are the same angle of θ, all the bent portions can be formed with the same jig in a process of producing a heat exchanger. Thus, the manufacturing efficiency is improved.

Since the bend angle θ is the same in all the bent portions, the U bends 18 connecting over the bent notch portions 21 are compatible with each other and not limited to a specific position in a designated column.

The U bends 17 used in the other portion are also compatible with each other and not limited to a specific position in the other column.

ThuS, the U bends 17 and 18 are respectively manufactured by common parts and the manufacturing cost is not increased.

In the front side heat exchanger **5*i*, the connecting positions of the U bends 17 to 19 are definitive: the U bends 17 are positioned in the air inlet side of the heat exchanger; the U bends 18 are positioned in the air outlet side thereof; and the U bend 19 is connected over the bent cut portion 20**.

Therefore, it is easy to confirm the positions where the U bends 17 to 19 are to be connected, without an error, so that the workability is improved.

In the above embodiment, the notch portions 21 of the heat radiating fin 12E are bent. However, the present invention is not limited to this embodiment. A plurality of cut portions can be bent at the same angle.

The cut portion and the notch portions 21 can be formed from the one edge **12*a* toward the other edge 12*b***, unlike in the above embodiment. In this case, the bent front side heat exchanger has a greater air inlet side and a smaller air outlet side.

In a side view, a triangular space is formed. However, the same advantages as in the aforementioned embodiment can be obtained: the sound of blowing air due to air current turbulence can be reduced; the U bends can be used in common; and the manufacturing efficiency and the workability can be improved.

In the above embodiments, the front and rear side heat exchangers **5*i* and 5*j* are bent from a single heat radiating fin 12E. However, the front and rear side heat exchangers 5*i* and 5*j*** can be formed independently and arranged to form an inverted V shape.

The front side heat exchanger **5*i* is bent in a number of stages to form a substantially circular arc, so that a portion opposing to the central axis O of the cross flow fan 8A most projects toward the front inlet port 2*a***.

Further, the lowermost heat exchanging pipe Pa is located forward by a distance $l_1$ in respect of the connect portion 25. The line $l_a$ is parallel with the tangent line $l_c$. The central axis line $l_b$ crosses the tangent line $l_c$ at right angles.

Therefore, a sufficient space is formed between the front side heat exchanger **5*i* and the front surface of the unit body 1 in a lowermost portion of the front side heat exchanger 5*i***. A filter (not shown) can be easily inserted in or drawn out from the space.

At the same time, an air outlet port 7 having a greater open area can be formed, resulting in that the amount of blown air can be increased and the air blowing efficiency can be improved, since the front drain pan **6*a* also serves as the nose of the air outlet port 7**.

Since a side portion of the rear drain pan **6*b*** forms a back nose, air passing through this portion flows smoothly without turbulence. Therefore, the sound of blowing air can be reduced.

The rear side heat exchanger **5*j*, introducing a smaller amount of air as compared to the front side heat exchanger 5*i***, is straight and does not have a bent portion, an efficient heat exchange can be performed without air current turbulence.

Figure 12:
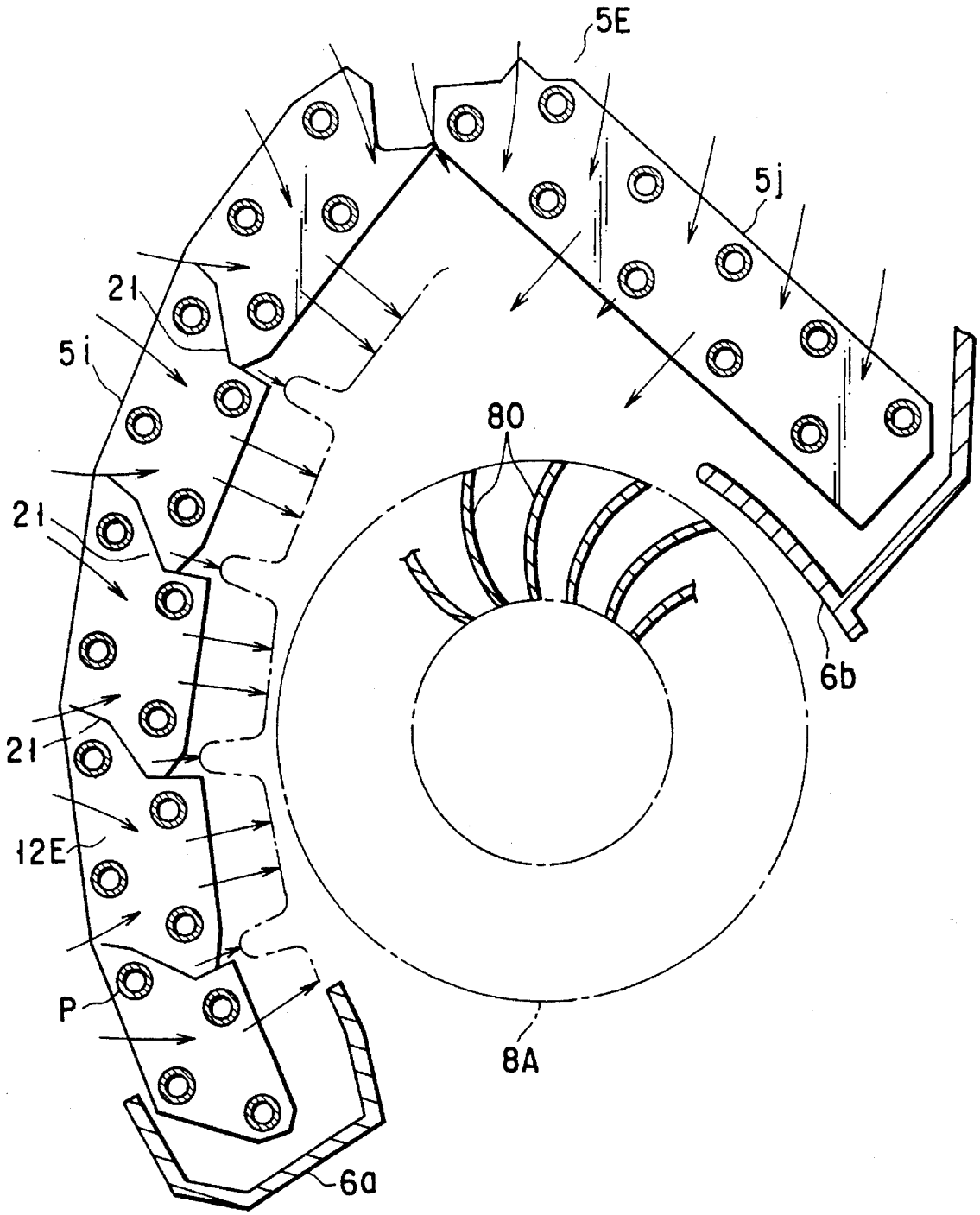

As shown in FIG. 12, the flow rate of air to be heat exchanged flows through the front side heat exchanger **5*i* varies as indicated by the dot-and-dash line on account of the structure of the heat exchangers. The dot-and-dash line is close to the front side heat exchanger 5*i*** where the flow rate is low (slow) and away from the heat exchanger where the flow rate is high (fast).

More specifically, since the ventilation resistance is great in the bent portions (the bent notch portions 21), the flow rate of air is low. In the other portions, since the ventilation resistance is relatively small, the flow rate of air is higher. Thus, a high flow rate portion and a low flow rate portion appear alternately, resulting in turbulence of air.

Since the bent portions of the front side heat exchanger **5*i* are formed along the axial direction of the cross flow fan 8A, the turbulence of air passing through these portions are introduced into the cross flow fan 8**A in the same phase.

However, since the cross flow fan is of a skew type in which the blades 80 are twisted so as to have an angle of sweepforward with respect to a direction of rotation, the blades 80 are phase-shifted with respect to the turbulence of air introduced in the same phase.

Therefore, even if the turbulence of air to be heat-exchanged is introduced along the axial direction with respect to the cross flow fan 8A, the phase shift of the blades 80 disperses the sound of blowing air due to the turbulence of blowing air to be heat-exchanged, performing a function of suppressing the sound of blowing air and achieving a silent operation.

Figure 13:
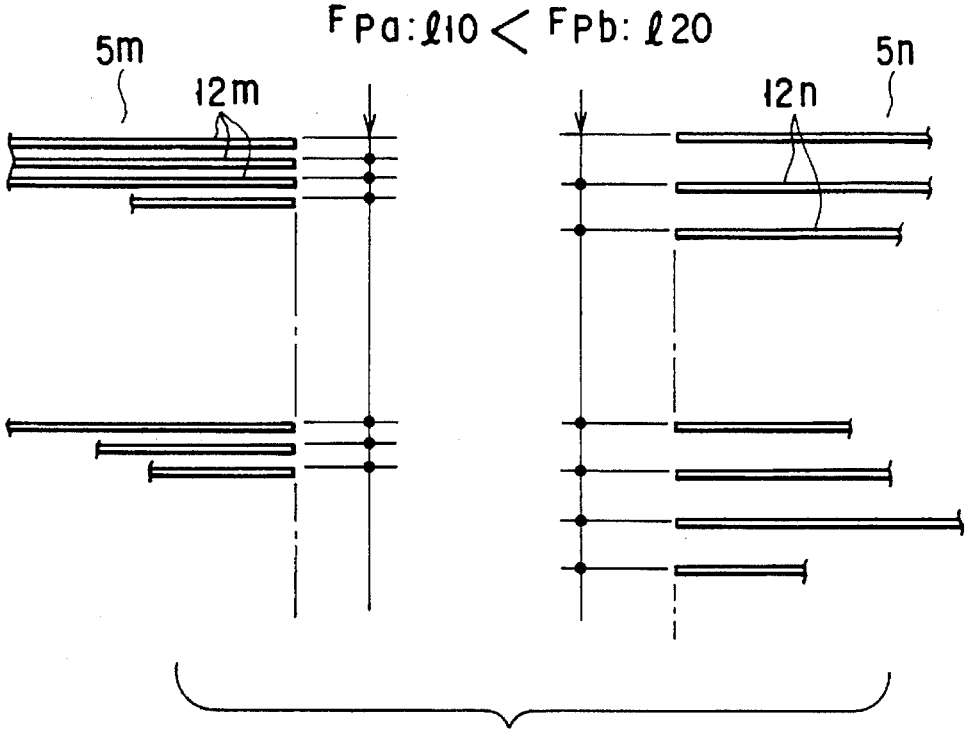
FIG. 13 is a diagram showing pitches of heat radiating fins according to another embodiment of the present invention.

Further, a front side heat exchanger **5*m* and a rear side heat exchanger 5n as shown in FIG. 13** can be used.

FIG. 13 shows heat radiating fins **12*m* constituting the front side heat exchanger 5*m*, a fin pitch Fpa of the fins 12*m*, heat radiating fins 12***n* constituting the rear side heat exchanger 5*n* and a fin pitch Fpb of the fins 12*n*.

In this embodiment, the fin pitch Fpa of the heat radiating fins 12*m* of the front side heat exchanger 5*m* is set at a narrow pitch l10 as in the above embodiment, whereas the fin pitch Fpb of the heat radiating fins 12*n* of the rear side heat exchanger 5*n* is set at a broad pitch l20.

It is preferable that the fin pitch Fpb of the rear side heat exchanger 5*n* be an integer number of times that of the fin pitch FPa of the front side heat exchanger 5*m*.

More specifically, a necessary number of heat radiating fins 12E as described above are prepared and upper portions above the cut portions 20 of heat radiating fins, of the number corresponding to the ratio of the fin pitch in the rear side-heat exchanger 5*n* to the fin pitch in the front side heat exchanger 5*m*, are cut off in advance.

The cut-off portions of the fins are disposed of, and the remaining lower portions of the fins are arranged at intervals l20 corresponding to the fin pitch Fpb of the front side heat exchanger 5*m*.

The heat radiating fins with the upper portions are arranged at intervals corresponding to the fin pitch Fpb of the rear side heat exchanger 5*n*.

As described above, it is only necessary that the heat radiating fins of a single type be prepared and the necessary number of fins, corresponding to the ratio of fin pitch of the rear side heat exchanger 5*n* to that the front side heat exchanger 5*m*, be additionally processed (cut). Therefore, the influence to the cost is suppressed.

In an actual operation, air introduced through the grill 3*a* fitted in the front inlet port 2*a* flows mainly to the front side heat exchanger 5*n* and air introduced through the grill 3*b* fitted in the upper inlet port 2*b* flows mainly to the rear side heat exchanger 5*m*.

The fin pitch Fpa of the heat radiating fins 12*m* of the front side heat exchanger 5*m* is set at a narrow pitch l10 as in the above embodiment, whereas the fin pitch Fpb of the heat radiating fins 12*n* of the rear side heat exchanger 5*n* is set at a broad pitch l20. Therefore, the heat exchanging efficiency of the front side heat exchanger 5*n* is high and that of the rear side heat exchanger 5*m* is low.

In other words, the efficiency of heat transfer in the rear side heat exchanger 5*m* is reduced as compared to that in the front side heat exchanger 5*n* by increasing the fin pitch Fpb of the rear side heat exchanger 5*m*. As a result, the refrigerant evaporating temperature in a cooling operation is lowered, thereby improving the dehumidifying performance.

Thus, the cooling performance is improved by means of the inverted V-shaped heat exchanger, while the dehumidifying performance can also improved due to the fin pitches as mentioned above.

Thus, a great amount of drainage is generated and adhered to the rear side heat exchanger 5*n* having the improved dehumidifying performance. However, since the fin pitch Fpb is set broad, the drainage easily flows down and does not remain in the fin 12*n*. Hence, a satisfactory heat exchanging operation is maintained without disturbing a flow of air to be heat-exchanged.

In a heating operation, the refrigerant is condensed and radiates heat of condensation. At this time also, since the fin pitch Fpb is set broad, the refrigerant condensing temperature is high.

Since the difference in temperature between the rear side heat exchanger 5*n* and the air flowing therethrough can be sufficiently great, hot air of a much higher temperature can be blown out of the heat exchanger. The heating efficiency is thus improved.

In the above embodiment, the fin pitch Fpb of the rear side heat exchanger 5*n* is set broader than that in the front side heat exchanger 5*m* in order to lower the efficiency of heat transfer in the rear side heat exchanger 5*n*. However, the following means may be employed for the same purpose.

Figure 14:
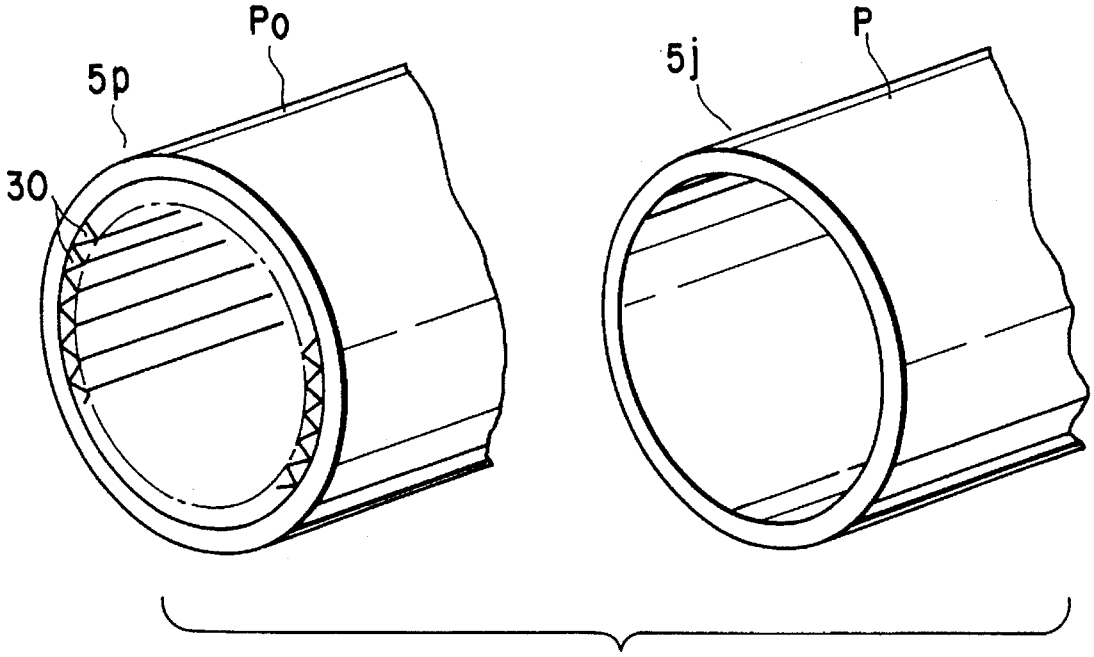
FIG. 14 is a diagram for explaining an internal structure of a heat exchanging pipe according to another embodiment of the present invention.

In this case, the heat radiating fin 12E as described above is used without being processed. In addition, a grooved tube, so-called a ripple tube, in which minute grooves 30 are formed integral with the tube as shown in FIG. 14, is used as a heat exchanging pipe $P_0$ of a front side heat exchanger 5*p*.

A heat exchanging pipe P of a rear side heat exchanger 5*j* is a normal pipe having no groove in an inner or outer surface.

With this structure, the heat exchanging efficiency of the heat exchanging pipe $P_0$ in the front side heat exchanger 5*p* is increased, while that of the heat exchanging pipe P in the rear side heat exchanger 5*j* remains unchanged.

As a result, as in the embodiment as described above, the efficiency of heat transfer of the front side heat exchanger 5*p* is increased, although that of the rear side heat exchanger 5*j* remains unchanged. Therefore, the dehumidifying performance of the rear side heat exchanger 5*j* in a cooling operation is improved, the drainage is collected without dropping, and the heat exchanging efficiency of the overall heat exchanger is also improved.

In a heating operation, since the condensation temperature of the rear side heat exchanger 5*j* is kept high and the difference in temperature between the rear side heat exchanger and the air flowing therethrough can be sufficiently great, hot air of a much higher temperature can be blown out of the heat exchanger. The heating efficiency is thus improved.

Figure 15:
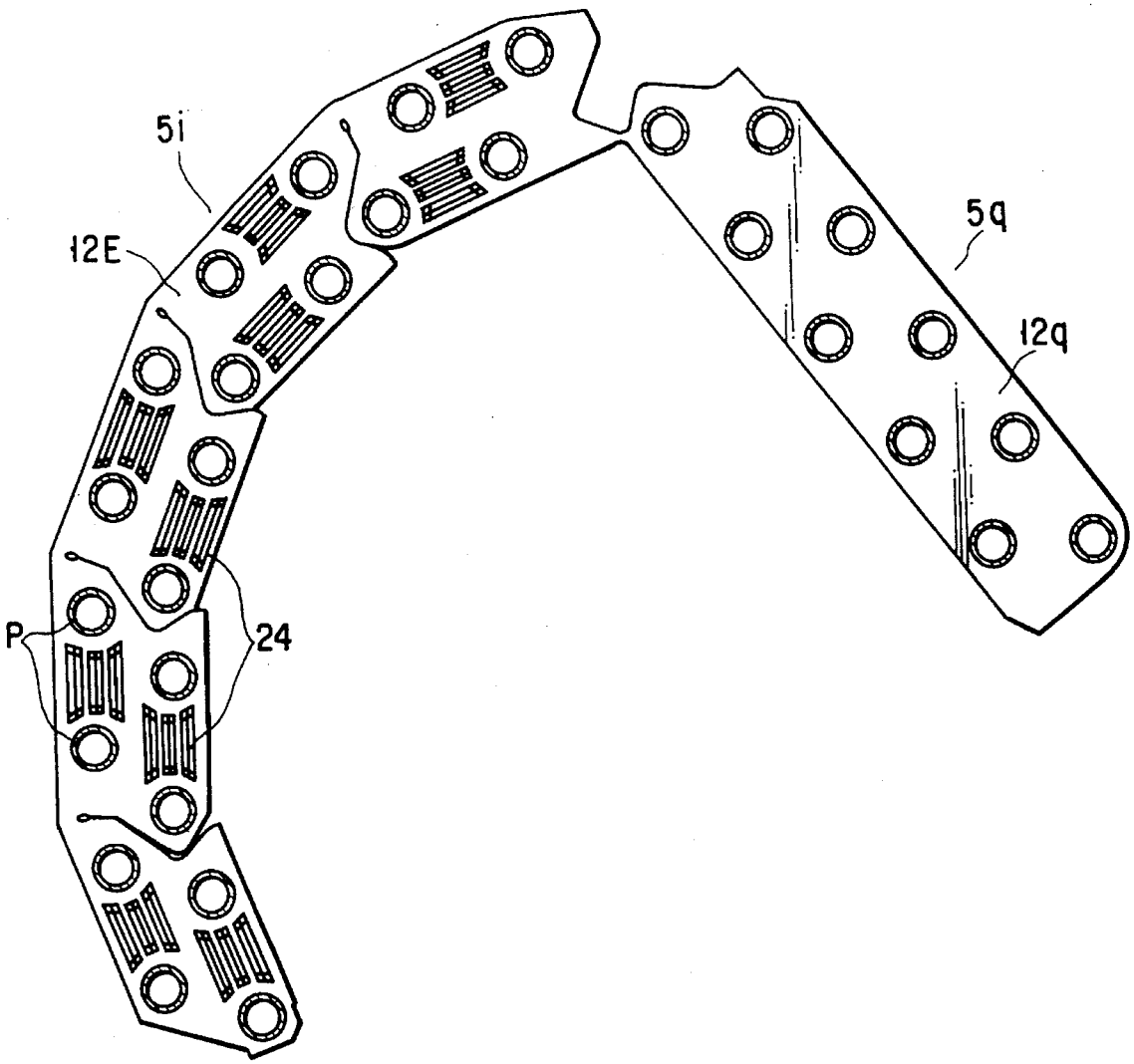
FIG. 15 is a longitudinal cross-sectional view of a heat exchanger according to another embodiment of the present invention.

Further, as shown in FIG. 15, raised slits (cut and raised slits) 24 are formed in a heat radiating fin 12E constituting a front side heat exchanger 5*i*.

A heat radiating fin 12*q* constituting a rear side heat exchanger 5*i* does not have any raised slit but is flat.

With this structure, the heat exchanging efficiency of the heat radiating fin 12E in the front side heat exchanger 5*i* is increased, while that of the heat radiating fin 12*q* in the rear side heat exchanger 5*q* remains unchanged.

As a result, as in the embodiment described above, the efficiency of heat transfer of the rear side heat exchanger 5*q* is lower than that of the front side heat exchanger 5*i*. Therefore, the same effects as in the above embodiment are obtained. In any of the above embodiments, a comfortably-conditioned air is always obtained with a low running cost.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An air conditioning machine comprising:

an air conditioning main body having an inlet port and an outlet port;

an air blowing fan, provided in the air conditioning main body, for introducing air in a room into the air conditioning main body through the inlet port and blowing the air into the room through the outlet port, the air blowing fan having a circular cross section; and a heat exchanger provided in an indoor air introducing side of the air blowing fan, bent at a portion along a longitudinal direction of the heat exchanger at an acute angle, and having a front side heat exchanger located on a front side of the air conditioning machine and curved along the circular cross section of the air blowing fan and a rear side heat exchanger located on a rear side thereof, the air blowing fan is a cross flow fan in which a plurality of blades are arranged at regular intervals in a circumferential direction;

the heat exchanger comprises a number of heat radiating fins arranged in parallel at small intervals and heat exchanging pipes inserted through the heat radiating fins; and each of the heat radiating fins has a cut portion, which is bent at an acute angle so as to form the front side heat exchanger and the rear side heat exchange, each of the heat radiating fins constituting the front side heat exchanger having a number of cut portions or notch portions and being curved in a plurality of stages by bending the cut portions or notch portions.

2. The machine according to claim 1, wherein:

each of the heat radiating fins has, in its upper portion, a cut portion extending from one side edge of the fin to a portion near another side edge thereof and is shaped into an inverted V shape; and a plurality of notch portions are formed at regular intervals below the cut portion, extending from one side edge of the fin to a portion near another side edge thereof, and are bent so that the front side heat exchanger is curved.

3. The machine according to claim 2, wherein:

each of the heat radiating fins constituting the front side heat exchanger has a notch portion extending from one side edge of the fin to a portion near another side edge thereof; and a bridge is formed across middle portions of edges of the notch portion.

4. The machine according to claim 3, wherein:

the bridge is a narrow arm and forms predetermined angles with respect to the side edges of the fin;

a middle portion of the bridge is bent to project in one direction so as to form a triangular cross section; and bridges of all the notch portions are folded so as to project in one direction.

5. The machine according to claim 2, wherein only the heat radiating fins constituting the front side heat exchanger have raised slits.

6. The machine according to claim 5, wherein each of the heat radiating fins has a number of raised slits classified in three patterns of raised slits of A pattern formed between adjacent holes for the heat exchanging pipes, raised slits of B pattern formed along one edge of a notch portion and raised slits of C pattern formed along another edge of the notch portion.

7. The machine according to claim 5, wherein:

the raised slits are formed in each of the radiating fins, except a region between the holes for the heat exchanging pipes and edges of the cut portion and the notch portions; and the heat exchanging pipes include a portion which lies over the cut portion or the notch portion and a portion which does not lie over any of these portions.

8. The machine according to claim 1, wherein each of the heat radiating fins constituting the front side heat exchanger has a plurality of cut portions or notch portions and is curved in a plurality of stages by bending the cut portions or notch portions.

9. The machine according to claim 8, wherein:

each of the heat radiating fins constituting the front side heat exchanger has holes for the heat exchanging pipes, arranged in two columns: one on an air introducing side of the air blowing fan; and the other on an air discharging side of the air blowing fan;

openings of adjacent heat exchanging pipes are connected by U bends; and

U bends which lies over bent portions formed by bending the cut portions or the notch portions are arranged in one of the air introducing side and the air discharging side.

10. The machine according to claim 9, wherein the U bends are classified in three types: first type of U bends which lie over the bent portions in accordance with a distance between openings of heat exchanging pipes by setting a bend angle in the front side heat exchanger; second type of U bends which do not lie over the bent portions in the front side heat exchanger or in the rear side heat exchanger; and third type of U bends which lie over a cut portion connecting the front side heat exchanger and the rear side heat exchanger.

11. The machine according to claim 8, wherein:

each of the heat radiating fins constituting the front side heat exchanger has at least two cut or notch portions and is bent at the cut or notch portions at the same angle so as to be curved in a plurality of stages to surround the air blowing fan; and the rear side heat exchanger is rectangular.

12. The machine according to claim 1, wherein the heat exchanging pipes in the rear side heat exchanger have a heat exchanging efficiency lower than that of the heat exchanging pipes in the front side heat exchanger.

13. The machine according to claim 12, wherein the heat radiating fins of the rear side heat exchanger are arranged at a fin pitch broader than that of the heat radiating fins of the front side heat exchanger, the fin pitch of the heat radiating fins in the rear side heat exchanger being preferably an integer number of times that of the fin pitch of the front side heat exchanger.

14. The machine according to claim 12, wherein the heat exchanging pipes only in the front side heat exchanger have grooves formed in inner surfaces of the pipes in order to increase a heat exchanging area.

15. An air conditioning machine comprising:

an air conditioning main body having an inlet port and an outlet port;

an air blowing fan, provided in the air conditioning main body, for introducing air in a room into the air conditioning main body through the inlet port and blowing the air into the room through the outlet port, the air blowing fan having a circular cross section; and a heat exchanger provided in an indoor air introducing side of the air blowing fan, bent at a portion along a longitudinal direction of the heat exchanger at an acute angle, and having a front side heat exchanger located on a front side of the air conditioning machine and curved along the circular cross section of the air blowing fan and a rear side heat exchanger located on a rear side thereof, the air blowing fan is a cross flow fan in which a plurality of blades are arranged at regular intervals in a circumferential direction;

the heat exchanger comprises a number of heat radiating fins arranged in parallel at small intervals and heat exchanging pipes inserted through the heat radiating fins; and each of the heat radiating fins has a cut portion, which is bent at an acute angle so as to form the front side heat exchanger and the rear side heat exchanger, wherein the air conditioning main body has a front inlet port opposing to the front side heat exchanger and a rear inlet port opposing to the rear side heat exchanger, wherein the heat exchanging pipes in the rear side heat exchanger have a heat exchanging efficiency lower than that of the heat exchanging pipes in the front side heat exchanger.

16. The machine according to claim 15, wherein the heat radiating fins of the rear side heat exchanger are arranged at a fin pitch broader than that of the heat radiating fins of the front side heat exchanger, the fin pitch of the heat radiating fins in the rear side heat exchanger being preferably an integer number of times that of the fin pitch of the front side heat exchanger.

17. The machine according to claim 15, wherein the heat exchanging pipes only in the front side heat exchanger have grooves formed in inner surfaces of the pipes in order to increase a heat exchanging area.

* * * * *